US010556725B2

(12) United States Patent
Breyburg

(10) Patent No.: US 10,556,725 B2
(45) Date of Patent: Feb. 11, 2020

(54) CONVERTIBLE PORTABLE ORGANIZER WITH LINER

(71) Applicant: 6 Pack Fitness, Inc., Oakland, CA (US)

(72) Inventor: Michael Breyburg, Walnut Creek, CA (US)

(73) Assignee: 6 PACK FITNESS, INC., Oakland, CA (US)

( * ) Notice: Subject to any disclaimer, the term of this patent is extended or adjusted under 35 U.S.C. 154(b) by 0 days.

(21) Appl. No.: 15/814,143

(22) Filed: Nov. 15, 2017

(65) Prior Publication Data

US 2019/0144164 A1 May 16, 2019

(51) Int. Cl.

| | |
|---|---|
| ***B65D 25/14*** | (2006.01) |
| ***F25D 3/08*** | (2006.01) |
| ***B65D 25/04*** | (2006.01) |
| ***B65D 43/16*** | (2006.01) |
| ***B65D 43/22*** | (2006.01) |
| ***B65D 85/18*** | (2006.01) |
| ***B65D 85/00*** | (2006.01) |
| ***A47B 43/00*** | (2006.01) |
| ***A47B 57/08*** | (2006.01) |
| ***B65D 81/38*** | (2006.01) |

(52) U.S. Cl.

CPC ..... *B65D 25/04* (2013.01); *A47B 43/006* (2013.01); *A47B 57/08* (2013.01); *B65D 25/14* (2013.01); *B65D 43/163* (2013.01); *B65D 43/22* (2013.01); *B65D 81/3813* (2013.01); *B65D 85/187* (2013.01); *B65D 85/70* (2013.01); *B65D 2543/00537* (2013.01)

(58) Field of Classification Search

CPC ..... B65D 25/14; B65D 43/163; B65D 43/22; B65D 81/3813; B65D 85/187; B65D 85/70; B65D 2543/00537; A47B 43/006; A47B 57/08

USPC ..... 220/495.01

See application file for complete search history.

(56) References Cited

U.S. PATENT DOCUMENTS

| | | | |
|---|---|---|---|
| 1,886,406 | A | 11/1932 | Kniffin |
| 4,295,432 | A | 10/1981 | Hulke |
| 4,523,526 | A | 6/1985 | O'Neill |
| 4,725,107 | A | 2/1988 | Appleton |
| 4,759,467 | A | 7/1988 | Byrne |

(Continued)

OTHER PUBLICATIONS

Notification of Transmittal of the International Search Report and Written Opinion of the International Searching Authority for International Application No. PCT/US18/61365, International Filing Date Nov. 15, 2018, dated Feb. 8, 2019, 19 pages.

(Continued)

*Primary Examiner* — J. Gregory Pickett
*Assistant Examiner* — Niki M Eloshway
(74) *Attorney, Agent, or Firm* — Dergosits & Noah LLP

(57) ABSTRACT

A convertible storage assembly is disclosed with a body with an interior space. In an embodiment, a removable waterproof liner may divide the space into first and second compartments. With a liner in place, the first compartment is accessible through a first removable barrier and is water-retaining due to the liner: and the second compartment is accessible through a second removable barrier. The size of the second compartment may be changed by deforming a flexible liner, or by changing from a first liner to a second liner of different shape.

16 Claims, 22 Drawing Sheets

(56) References Cited

U.S. PATENT DOCUMENTS

| | | | | |
|---|---|---|---|---|
| 5,216,900 | A | 6/1993 | Jones | |
| 5,403,095 | A | 4/1995 | Melk | |
| 5,427,308 | A | 6/1995 | Swift et al. | |
| 5,630,537 | A | 5/1997 | Sciacca | |
| 5,810,457 | A | 9/1998 | Felsenthal et al. | |
| 5,842,571 | A | 12/1998 | Rausch | |
| 6,105,859 | A | 8/2000 | Stafford | |
| 6,435,390 | B1 | 8/2002 | Abramowicz | |
| 6,595,604 | B1 | 7/2003 | Peterson | |
| 6,612,434 | B1 | 9/2003 | Redzisz | |
| 6,688,470 | B2 | 2/2004 | Dege et al. | |
| 6,941,698 | B2 | 9/2005 | Telles | |
| 7,313,927 | B2 | 1/2008 | Barker | |
| 7,337,999 | B2 | 3/2008 | Kim | |
| 8,844,756 | B2 | 9/2014 | Beyburg | |
| 2002/0084206 | A1 | 7/2002 | Protopapas | |
| 2006/0144077 | A1 | 7/2006 | Morris | |
| 2007/0272719 | A1 | 11/2007 | Laughton | |
| 2008/0006639 | A1* | 1/2008 | Davis | B65D 25/04 220/507 |
| 2008/0229778 | A1* | 9/2008 | Shelton | A45F 3/04 62/457.5 |
| 2011/0030415 | A1* | 2/2011 | Breyburg | F25D 25/00 62/441 |
| 2011/0064334 | A1 | 3/2011 | Sormus et al. | |
| 2012/0273505 | A1 | 11/2012 | Bose | |
| 2012/0321226 | A1* | 12/2012 | Hansen | A45C 13/02 383/104 |
| 2013/0341338 | A1* | 12/2013 | Mitchell | A45C 11/20 220/592.2 |
| 2014/0041558 | A1* | 2/2014 | Lubotta | E05G 1/08 109/38 |
| 2016/0060004 | A1* | 3/2016 | Dunn | A47G 19/02 222/144.5 |
| 2017/0150843 | A1* | 6/2017 | Rosalia | A47J 43/044 |
| 2017/0254578 | A1 | 9/2017 | Kriesel | |
| 2018/0141739 | A1* | 5/2018 | Hengen | B65D 81/3813 |
| 2018/0187962 | A1* | 7/2018 | Stollenwerck, III | F25D 23/069 |
| 2018/0194533 | A1* | 7/2018 | Bramwell | B65D 81/3813 |

OTHER PUBLICATIONS

Corrected Notification of Transmittal of the International Search Report and Written Opinion of the International Searching Authority for International Application No. PCT/US18/61365, International Filing Date Nov. 15, 2018, dated Feb. 8, 2019, 20 pages.

* cited by examiner

CONVERTIBLE PORTABLE ORGANIZER WITH LINER

CROSS-REFERENCE TO RELATED APPLICATIONS

The present application is related to U.S. Pat. No. 8,844,756, entitled "PORTABLE CONSUMABLES ORGANIZER," filed on Sep. 30, 2012, which is incorporated by reference in its entirety.

BACKGROUND

In today's world, a person may have many tasks to perform in a single day, each task requiring different items of equipment, food, beverage, or a combination of these. For example, during a single day, a user may need hot and cold food, beverages, and a host of other personal effects. Easily-portable lunch pails and small coolers (e.g., storage carriers) are popular, but can make it difficult to access the items stored within. This may lead to a user not knowing what is stored within. It may further lead to a user having multiple such carriers, each suitable for a specific task, none suitable for all tasks. Thus, there exists a need for a convertible storage assembly that adapts to the user's needs.

SUMMARY

In an embodiment, a convertible storage assembly includes a first compartment. The first compartment may be fitted with a first access (e.g., a top lid), a collapsible and removable shelving unit, a second access door (e.g., a hatch in a side of the compartment) to reach the shelving unit, and a removable liner fitted to line the first compartment. In embodiments, the storage assembly may have a hard shell or a soft shell. In embodiments, the liner configuration may be changeable, either by deforming the liner (e.g., by folding or wrinkling the liner), or by substituting one liner for a second liner with a different configuration.

In an embodiment, a convertible storage assembly may include a shelving unit, a top access, an access hatch located on a side of the assembly toward the center of the assembly, and a waterproof liner. The shelving unit is accessible through the side access hatch, but not the top access when the liner drapes over the shelving unit. The liner, draping over the shelving unit, creates storage spaces on either side of the shelving unit. The storage spaces are accessible through the top access, but not the side access.

In an embodiment, a convertible storage assembly may include a shelving unit, a top access, an access hatch located on an end of the assembly or on a side of the assembly toward an end of the assembly, and a waterproof liner. The shelving unit is accessible through the side access hatch, but not the top access when the liner drapes over the shelving unit. The liner, draping over the shelving unit, creates a space in the remainder of the storage assembly that is water-retentive. The storage space is accessible through the top access, but not the side access.

In an embodiment, a convertible storage assembly may have a second side access hatch to a second shelving unit. The second shelving unit may be configured differently from the first. That is, the second shelving unit may be configured for a particular use (e.g., holding fishing tackle). In an embodiment, the first and second access hatches may be located at opposing ends of the convertible storage assembly. The liner then drapes over both first and second storage assemblies, creating a storage space in between. The storage space is accessible through the top access, but not either side access. In an embodiment, one side access may be toward the end of the assembly, with the second side access located toward the center, such that the first and second shelving units (or first and second stacks of containers, etc.) are adjacent to each other. In the embodiment, the liner draping over both first and second shelving units creates a storage space at the end of the assembly that is not occupied by a shelving unit. The liner makes the first and second shelving units accessible by the first and second accesses, respectively, but not accessible through the top lid.

In an embodiment, a convertible storage assembly includes a first compartment and a second compartment. The first compartment may be fitted with a first access (e.g., a top lid), a collapsible and removable shelving unit, a second access door (e.g., a hatch) to reach a shelving unit (e.g., in a side of the first compartment), and a removable liner fitted to line the first compartment. The second compartment may be adapted to contain a compartmentalized unit. In an embodiment, the second compartment may be separable from the first compartment. In embodiments, the storage assembly may have a hard shell or a soft shell. In embodiments, the first compartment may have a soft shell and second compartment may have a hard shell, or vice versa. In embodiments, the liner configuration may be changeable, either by deforming the liner (e.g., by folding or wrinkling the liner), or by substituting one liner for a second liner with a different configuration.

In an embodiment, a convertible storage assembly may include a first compartment and a compartmentalized unit. The first compartment may be fitted with a first access (e.g., a top lid), a collapsible and removable shelving unit, a second access door (e.g., a hatch in a side of the first compartment) to reach the shelving unit, and a removable liner fitted to line the first compartment. The compartmentalized unit may be separable from the first compartment. In embodiments, the storage assembly may have a hard shell or a soft shell. In embodiments, the first compartment may have a soft shell and the compartmentalized unit may have a hard shell, or vice versa. In embodiments, the liner configuration may be changeable, either by deforming the liner (e.g., by folding or wrinkling the liner), or by substituting one liner for a second liner with a different configuration.

In an embodiment with a first compartment and a second compartment, the first compartment may include a shelving unit, a top access, an access hatch located on a side of the assembly toward the second compartment, and a liner. The shelving unit is accessible through the side access hatch, but not through the top access when the liner drapes over the shelving unit. The liner, draping over the shelving unit, creates a storage space on the side of the shelving unit opposite the second compartment. The storage space is accessible through the top access, but not through the side access.

In an embodiment with a first compartment and a second compartment, the first compartment may include a shelving unit, a top access, an access hatch located on an end of the assembly or on a side of the assembly toward an end of the assembly, and a waterproof liner. The shelving unit is accessible through the side access hatch, but not through the top access when the liner drapes over the shelving unit. The liner, draping over the shelving unit, creates a storage space in the remainder of the storage assembly. The storage space lies between the second compartment and the shelving unit, and accessible through the top access, but not the side access.

In an embodiment, a convertible storage assembly may include a hard shell, removable inner partitions, an upper access lid, and a side-access door. In the embodiment, one or more removable partitions may divide an inner space of the storage assembly into two or more compartments, one of the compartments being accessible through the side-access door. In an embodiment, a shelving unit positioned within the storage assembly is accessible through the side access door. In an embodiment with two partitions dividing the inner space into three compartments, the side-access door provides access to the central compare e t. In an embodiment, compartments are made water-retentive, either by the partitions forming water-tight seals with the inner surface of the storage assembly, or through the user of one or more waterproof liners. In an embodiment, a liner may be fitted to line the interior of the hard-shell storage assembly in the absence of any partition. In an embodiment, the side-mounted access door creates a waterproof seal with the outer shell of the hard-shell storage assembly. In an embodiment with at least one partition dividing the inner space into at least two compartments, the side-access door provides access to a compartment located on an end of the assembly, and a partition creates a watertight seal with the inner surface of the assembly, such that one of the one or more compartments is water-retentive. In an embodiment, the two end compartments are made water-retentive, either by the partitions forming water-tight seals with the inner surface of the storage assembly, or through the user of one or more waterproof liners. In an embodiment, the hard-shell storage assembly includes a second side-access door for providing access to a second shelving unit. The second shelving unit may be a compartmentalized shelving unit.

In embodiments, a liner may be waterproof, making storage spaces lined by the liner water-retentive.

Other objects, features, and advantages of the embodiments will become apparent upon consideration of the following detailed description and the accompanying drawings, in which like reference designations represent like features throughout the figures.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Figure 1B:
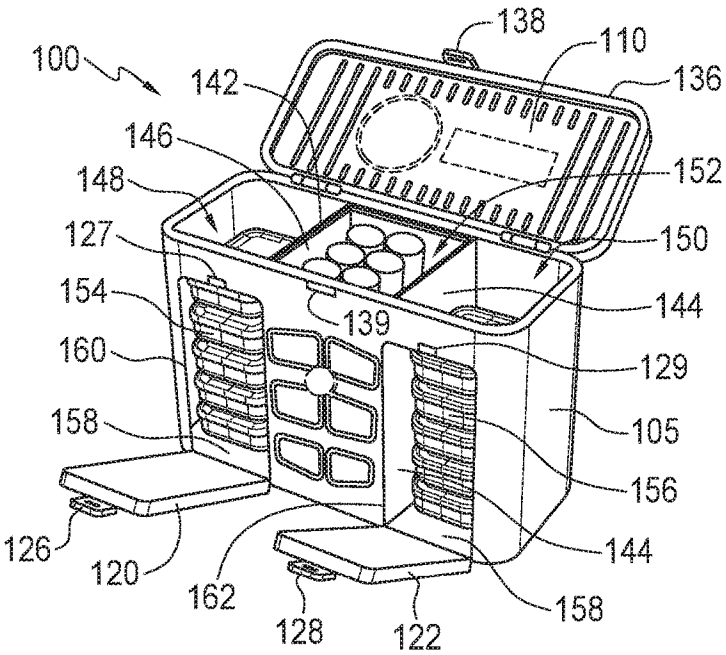
FIGS. 1*a*-1*c* are top perspective views illustrating a convertible storage assembly according to an embodiment.
Figure 1A:
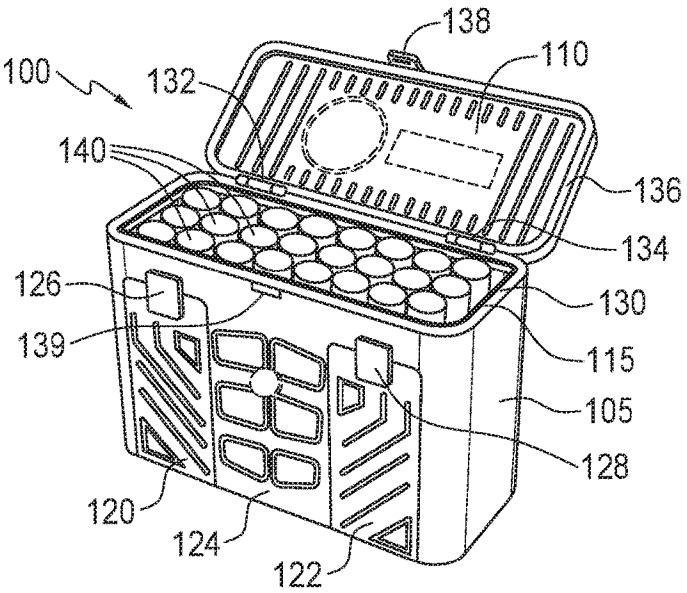
Figure 1C:
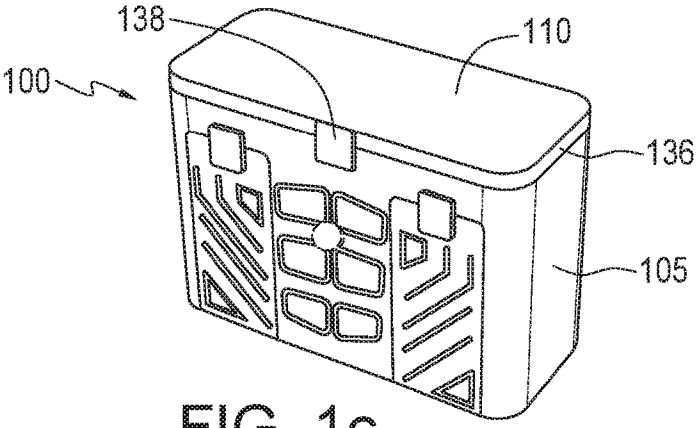

FIGS. 1*a*-1*c* are top perspective views illustrating a convertible storage assembly 100 according to an embodiment. Convertible storage assembly 100 may also be denoted as a convertible organizer, bag, case, carrier, or other similar designation. In FIG. 1*a*, convertible storage assembly 100 includes an outer shell 105, a lid 110, and a liner 115. In the embodiment of FIG. 1*a*, outer shell 105 and lid 110 are rigid or hard, but in other embodiments the shell and lid may be covered by a soft, cushioning, or insulating material, or may be soft and flexible. In an embodiment, the lid may be rigid, and fashioned to engage a rigid rim of an otherwise soft and flexible shell. Similarly, in an embodiment, the lid may be flexible and fashioned to engage with a rigid rim of a hard-shell case.

Returning to FIG. 1*a*, outer shell 105 includes access hatches 120, 122 separated by a shell section 124. Lid 110 and access hatches 120, 122 all provide access to an interior space, shown filled with exemplary contents 140, which symbolically depict beverage containers. Hatch 120 is held closed using a latch 126 and hatch 122 is held closed using a latch 128. Hatches in general may also be denoted as access panels, doors, flaps, or other types of removable barriers to entry. Outer shell 105 further includes a shell rim 130 with hinges 132, 134 attached to a lid rim 136. Lid 110 is held closed by a latch 138 that releasable engages a latch engage 139 on outer shell 105. In the embodiment, which includes liner 115 lining the inner surfaces of outer shell 105 and access hatch 120, 122, should either of access hatch 120 or 122 be opened, liner 115 would be visible. If liner 115 were flexible, contents 140 may then distort the liner without the support of the latch. For this reason, in an embodiment, liner 115 may be rigid.

In FIG. 1*b*, liner 115 has been removed. Convertible storage assembly 100 is instead equipped with partitions 142, 144. Partitions 142, 144 may be slid in place within slots (FIG. 2*a*) formed in the inner surface of outer shell 105. The addition of partitions 142, 144 divides the available space into compartments 148, 150, and 152. Compartment 152 is shown lined with a waterproof liner 146 and holding canned beverages. Compartment 148 is shown to be accessible through both lid 110 and access latch 120, such access providing two ways to reach containers 154 shown stacked within compartment 148. Similarly, compartment 150 is shown to be accessible through both lid 110 and latch 122, such access providing two ways to reach containers 154 stacked within compartment 152. In FIG. 1*b*, containers 154, 156 are shown to be separate containers stacked one on the other, the stack resting on a floor 158 of the inner surface of outer shell 105. In the embodiment, floor 158 is a rigid base upon which storage assembly 100 may be rested.

In some embodiments, shelving units may be inserted into compartments 148, 150, e.g., to provide more defined spaces for containers, or to provide more protection for items not already in protective containers. Such shelving units are discussed in more detail regarding FIGS. 4-7*b*. For embodiments using a liner, and particularly a flexible liner, the use of shelving units that provide structure serve to define a space where a container may be inserted without having to push the liner out of the way, as will be discussed.

FIG. 1*b* further shows latch engages 127, 129 for latches 126, 128 to use in keeping access hatches 120, 122 closed. And, in the embodiment, hatches 120, 122 contact flush against inner edges 160, 162, respectively, of outer shell 105. In FIG. 1*c*, lid 110 is shown held closed by latch 138.

FIGS. 1*a*-1*c*, illustrate aspects of the convertible nature of storage assembly 100, by disclosing that a first liner 115 may line the entire inner surface of outer shell 105, and a second liner 146 may line a smaller space. A second aspect of the convertible nature of storage assembly 100 is shown by hatches 120, 122 providing access to containers 154, 156 where storage assembly 100 is fitted with partitions 142, 144, but not providing access to contents 140 where storage assembly 100 is fitted with liner 115.

Figure 4:
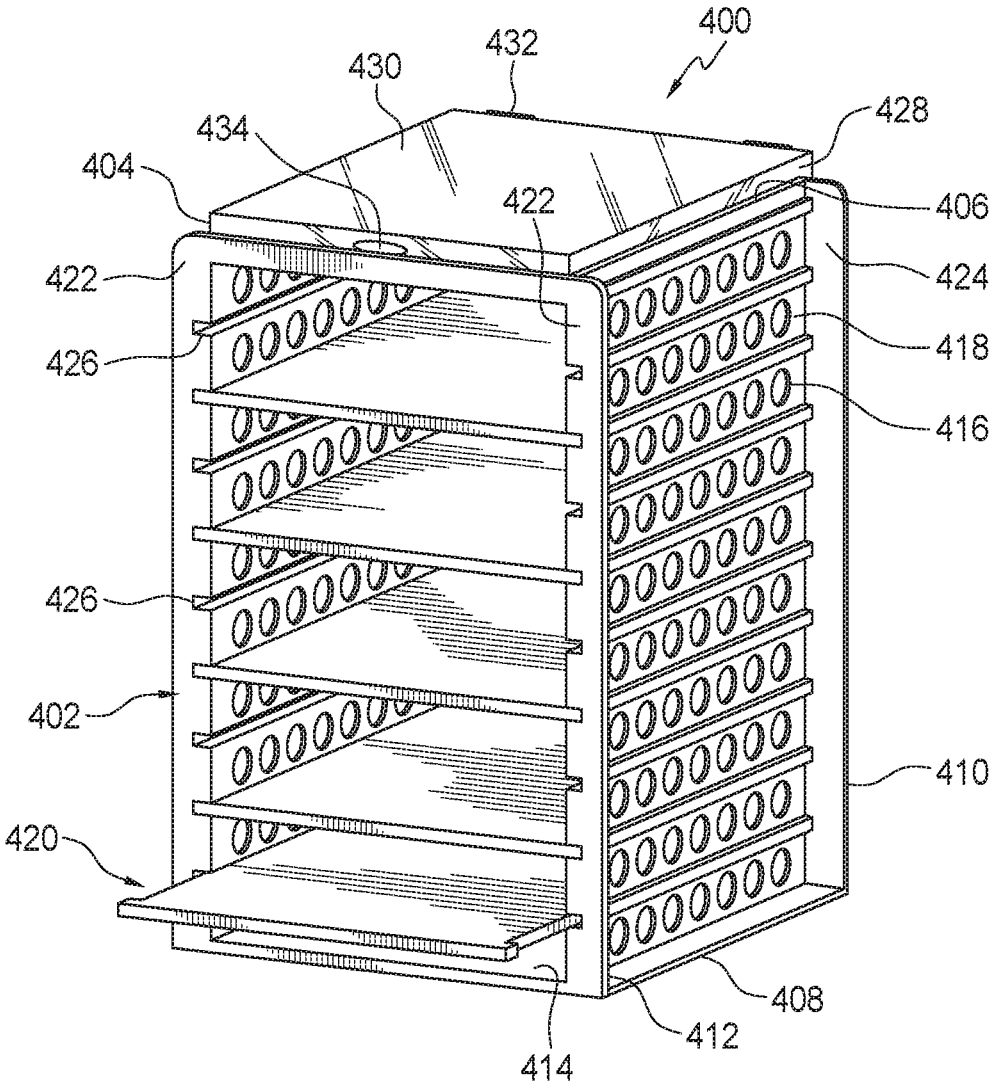
FIG. 4 is a top, front perspective view illustrating a rigid structure and upper tray for use in a convertible storage assembly, according to an embodiment.

In embodiments, any or all of shell bodies, lids, partitions, partitions, and liners may be constructed to have insulating properties. In addition, embodiments may accept packets intended to affect the temperature of the contents of the storage assembly (e.g., ice bags, or heating units). Such packets may be received by the storage assembly in compartments specifically disposed in the storage assembly for such purposes. For example, FIG. 4 illustrates an area on the surface of sidewall 418 and between edges 410 and 412 that is dimensioned to accept a cooling or heating packet. FIG. 4 illustrates just one way a storage assembly could accommodate such packets, others are described in U.S. Pat. No. 8,844,756, entitled "Portable Consumables Organizer," which is incorporated by reference in its entirety.

Figure 2B:
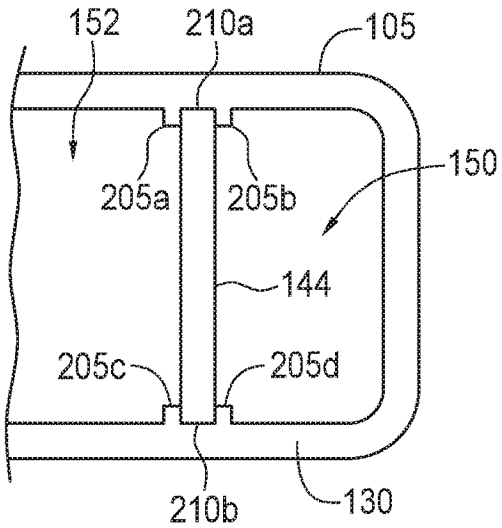
FIG. 2*b* is a top view illustrating a detail of FIG. 2*a;*
Figure 2A:
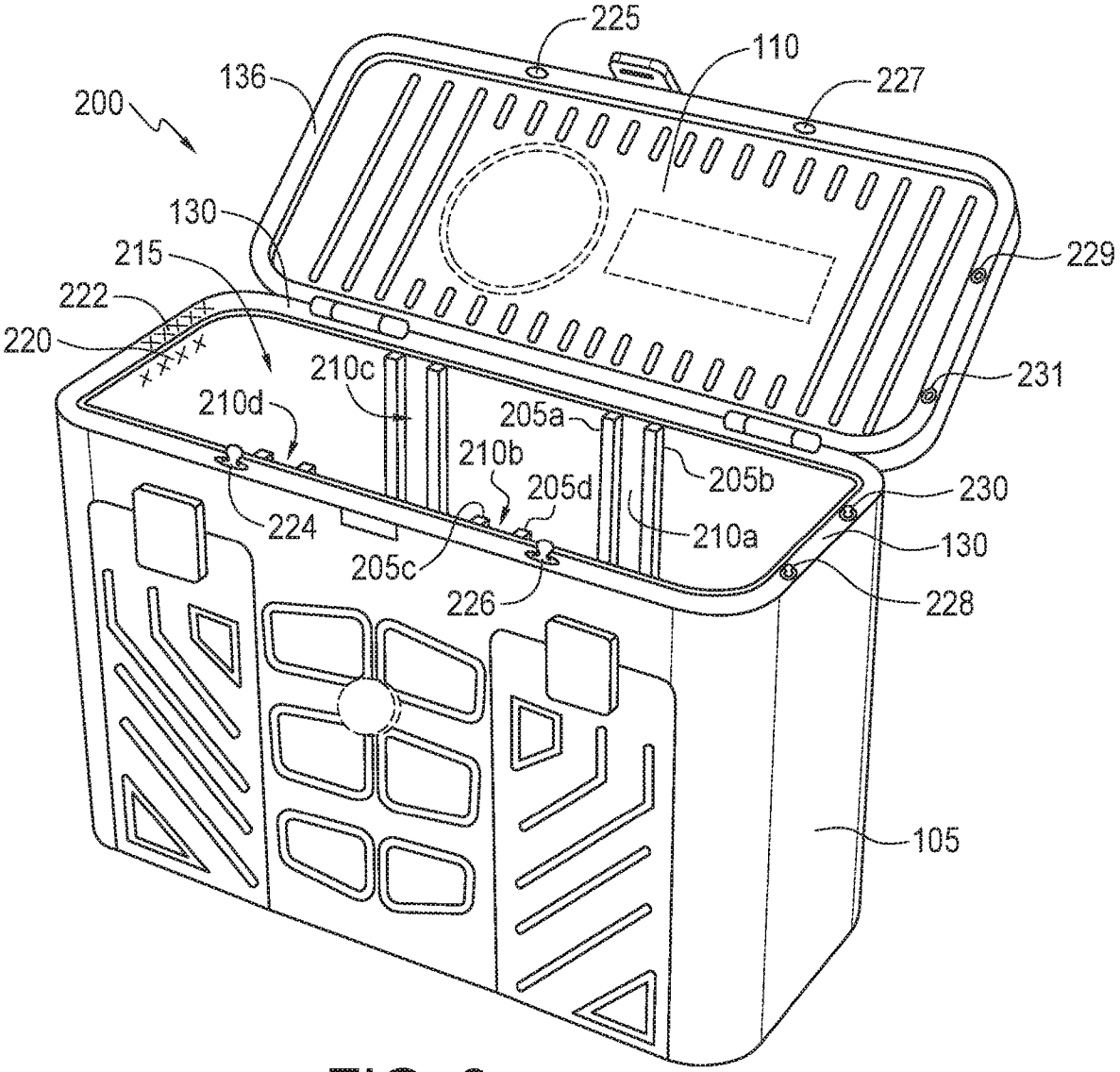
FIG. 2*a* is a top perspective view illustrating a convertible storage assembly according to an embodiment.

FIG. 2*a* is a top perspective view illustrating a convertible storage assembly according to an embodiment. In FIG. 2*a*, a convertible storage assembly 200 may include slots 210*a* . . . 210*d* formed within the inner surface of outer shell 105 for receiving partitions 144, 146 (FIG. 1*b*). Not shown are similar slots that may be formed in floor 158 connecting slot 210*a* to 210*b* along floor 158. Similarly, slots 210*c* and 210*d* may be connected by a slot in floor 158. In the embodiment, slots 210*a* . . . 210*d* are formed by the addition of slot edges, e.g., slots edges 205*a* . . . 205*d*. A space 215 includes the entire inner space of convertible storage assembly 200. Space 215 is defined by the inner surfaces of lid 110, outer shell 105, and hatches 120, 122 (FIG. 1*b*). FIG. 2*b* is a top view illustrating a detail of FIG. 2*a* in which partition 144 has been inserted into slots 210*a*, 210*b*, dividing space 215 into compartment 150 and compartment 152. With the similar addition of partition 142 (FIG. 1*b*) space 215 is divided into compartments 148 (not shown), 150, and 152. In an embodiment, the seal between partitions 144, 142 and outer shell 105 may be made watertight, eliminating the need for liner 146. In an embodiment, slots 210*a* . . . 210*d* may be formed directly in outer shell 105 without the addition of slot edges 205*a* . . . 205*d*.

In FIG. 2*a*, convertible storage assembly 200 illustrates various methods of attaching a liner. One method is to affix hook and loop sections, e.g., section 222, which may be Velcro™ sections, about the top edge of rim 130, for joining to mating hook and loop sections (e.g., mating hook and loop section 325*a*, FIG. 3*a*) on a corresponding rim section of a liner (e.g., liner 300, FIG. 3*a*). One such section 222 is shown, but that is just to illustrate placement. Many such sections about rim 130 would be preferable. In a modified version of this method of attachment, hook and loop sections, e.g., section 220, may be affixed to the inner surface of outer shell 105, with mating hook and loop sections (e.g., mating hook and loop section 325*b*, FIG. 3*a*) on a liner (e.g., liner 300, FIG. 3*a*). In an addition method of attachment, pegs or nubs, e.g., pegs 224, 226 may be provisioned about rim 130. Corresponding holes (e.g., holes 315*a*, 315*b*, FIG. 3*a*) in a liner (e.g., liner 300, FIG. 3*a*) fit over pegs 224, 226. And, when lid 110 closes, pegs 224, 226 are received by recesses 225, 227 formed within lid 110. Only two such pairs of pegs and recesses are shown, but, as with the hook and loop method, more such pairs would be preferable for their increased ability to retain a liner. And, as with the pegs and recesses, pairs of snaps 228, 230 and corresponding recesses 229, 231 may be provisioned in rim 130 and lid rim 136, respectively, with the liner having a mating snap part (e.g., mating snap part 320*a*, 320*b*, FIG. 3*a*) for each of snaps 228, 230. The liner attachment methods discussed with regard to FIGS. 2*a* and 3*a* may be used to attach any of the liners discussed in this specification.

Figure 3A:
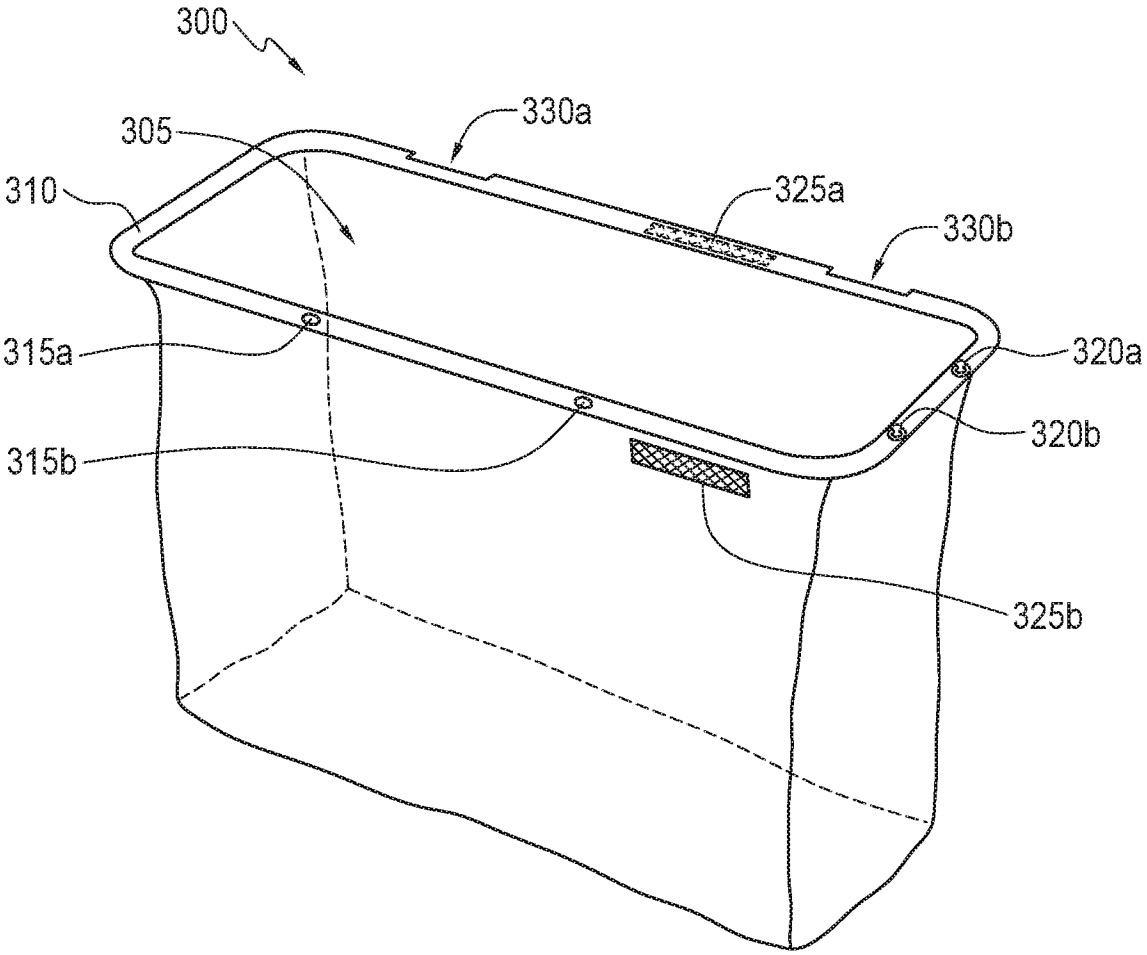
FIGS. 3*a*-3*c* are perspective views illustrating liners for use in convertible storage assemblies according to embodiments.
Figure 3B:
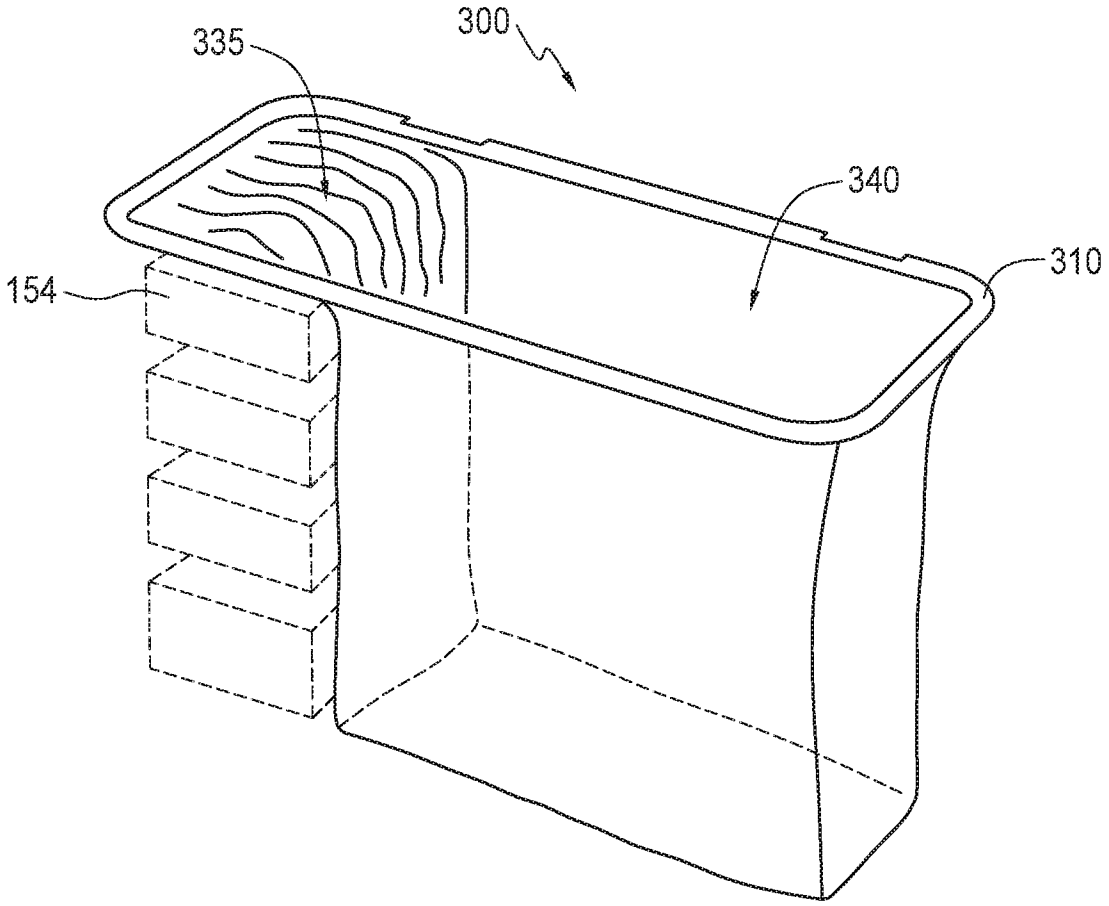
Figure 3C:
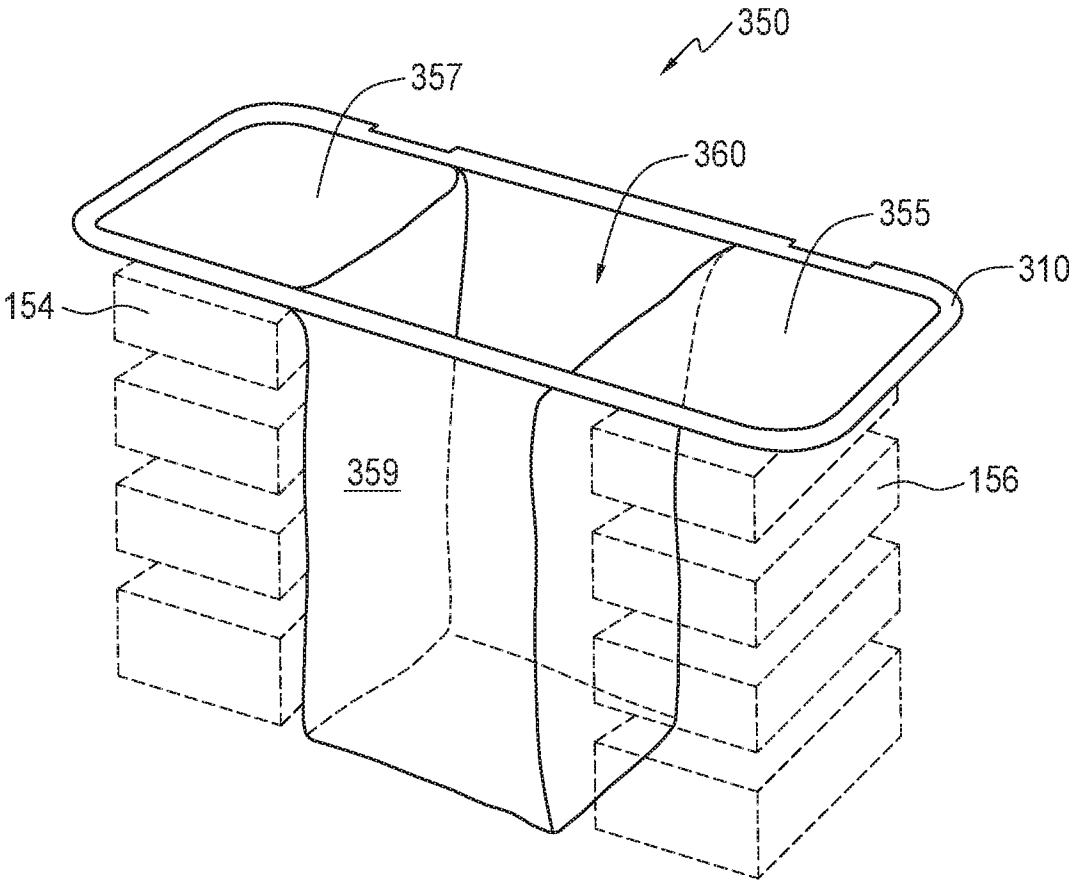

FIGS. 3*a*-3*c* are perspective views illustrating liners for use in convertible storage assemblies according to embodiments. For clarity, in FIGS. 3*a*-3*c*, and 9*a*-14 the liners are shown without the associated outer shell. In FIG. 3*a*, liner 300 has a liner rim 310 and hinge cut-outs 330*a*, 330*b*. Liner rim 310 may be flexible, or rigid. If rigid or formed to positively engage shell rim 130, or both rigid and formed to engage shell rim 130, liner rim 310 may reduce the need for hook and loop sections, pegs, or snaps. Liner rim 310 may engage shell rim 130 to support the rest of the liner, e.g., by resting on top of shell rim 130 or being fashioned to positively engage shell rim 130. Liner 300 is shown dimensioned to line the entire inner surface of outer shell 105 (FIG. 1*a*) and access hatches 120, 122. As such, liner 300 would serve just as liner 115. In the embodiment, liner 300 is flexible such that it may be moved to create space behind hatches 120, 122, to accommodate, for example, containers 154, 156 (FIG. 1*b*). In an embodiment, liner 300 may be waterproof so that the seal between hatches 120, 122 and shell body 105 need not be waterproof.

FIG. 3*b* illustrates a benefit of an embodiment in which liner 300 is flexible and waterproof. In FIG. 3*b* wrinkles 335 illustrate the movement of liner 300 to accommodate containers 154 within the space behind hatch 120. The addition of containers 154 reduces the lined volume to a volume 340 from the previous volume 305 (FIG. 3*a*). A benefit of liner 300 being flexible is that a user may open hatch 120, move liner 300 away, and insert containers 154 within. Liner 300 then deforms or wrinkles to accommodate containers 154 and still provides a lined volume 340 elsewhere. Thus, liner 300 allows the space behind hatch 120 to be converted from a water-retaining space (space 305), which is accessible from above, to a space for other items that are then accessible through hatch 120. Though not shown, the utility of hatch 122 would similarly benefit from the flexibility of liner 300.

In an embodiment, liner 300 may not be waterproof, yet it would still provide the benefit of a separate volume 340 for things that a user would rather not mix with containers 154. For example, containers 154 might hold food, while the user wishes to use volume 340 for clothing or shoes.

In an embodiment, liner 300 may be dimensioned to be able to deform to accommodate containers 154 and additional containers 156 and yet have enough material so that the entire volume between containers 154, 156 may be utilized (e.g., space 360, FIG. 3*c*).

FIG. 3*c* illustrates a liner 350 that is dimensioned to provide space for containers 154, 156 without having to deform the liner. Liner 350 includes top sections 355, 357 that are attached to liner rim 310. In contrast to wrinkles 335 of liner 300, liner 350 has relatively flat sections 357, 359. Top sections 355, 357 prevent access to containers 154, 156 from above. Dimensioned in this way, liner 350 accommodates containers 154, 156 without liner 350 needing to be pushed aside by the user to make space for containers 154, 156. Dimensioned in this way, liner 350 may also provide more interior space, since space 360 would not be reduced to accommodate wrinkled liner material 335. Since liner 350 does not have to deform to accommodate containers 154, 156, liner 350 may be rigid. Thus, top sections 355, 357 could be rigid, flat sections suitable for use as cutting boards or small tables, or could be fitted with, e.g., cup holders.

Containers 154, 156 may be replaced by other structures for holding or organizing. Other such structures are described with reference to FIGS. 4-7*b*. FIG. 4 illustrates a shelving structure 400. In embodiments, compartments of convertible storage assemblies, e.g., compartments 148, 150, may removably receive a shelving structure 400 which may be rigid or substantially rigid and as shown in more details in FIG. 4. Structure 400 and shelves 420 (FIG. 4) may be formed from any suitable material, including, but not limited to, plastic, polyvinyl chloride, polyethylene terephthalate glycol, corrugate, rubber, aluminum, or other suitable metals that allow for independent accessibility to storage containers (or other items) storable therein.

In an embodiment, the shelving structure 400 may be, in at least some implementations, defined by a generally vertically-aligned sidewall 418, with a cavity 402 within. Sidewall 418 may comprise a top 406 and a bottom edge 408, and two side edges, a rear side edge 410 and a front side edge 412; a generally vertically aligned back wall disposed in-between rear side edges of the two side walls 418, and an optional bottom wall 414 disposed in-between the front side edges of the two side walls 418.

In an embodiment and as shown, one or more sidewalls may include apertures 416 extending from an interior surface of side wall 418 to its exterior surface. The apertures may enable air to pass to and from the rigid structure cavity 402. The apertures 416 may take on any suitable shape. As shown, the apertures in the side walls have substantially round shapes. The back wall includes back wall apertures or slits which have an elongated shape. Back-wall slits (not shown) enable the engagement of shelves 420 with the structure's back wall.

In an embodiment, and as shown in FIG. 4, side wall 418 rear and front edges 410 and 412 include extensions 422 and 424, which may extend perpendicularly (with respect to the surface of the sidewalls) from the front and back edges of the side walls. The extensions 422 and 424 may create recesses for removably receiving temperature modification material, e.g., ice packets. In the embodiment shown, the side wall extension on the back edge of a side wall is formed integral with the back wall, or in other words, the width of the back wall is sufficiently dimensioned as to extend beyond the width of a shelf 420 within the structure. As can be appreciated, the packets disposable within the recesses between extensions 422, 424 may be a single packet or a plurality of individual separate packets. The packets may be vertically or horizontally aligned and or stacked in the recesses.

In the implementation of FIG. 4, an inside surface of the shelving structure 400, may comprise a plurality of guiding tracks 426 which may be integrally formed with the inside surface of a side wall and configured for receiving at least one shelf 420. Guiding tracks 426 may be disposed on both the side walls with a guiding track on one side wall substantially extending parallel to a matching guiding track on the opposite side wall, thus forming a paired set of guide tracks. As shown, apertures 416 formed in the side walls may be grouped in rows extending from the front to the back end of a side wall, and the rows may be vertically spaced apart from each other. In the embodiment shown, the guiding tracks may be formed between the rows of side wall apertures. The shelves may be formed from any suitable material, including, but not limited to, hard plastic, EVA, aluminum, and/or other rigid materials.

The shelving structure 400 may be further provided with an optional top wall disposed opposite an optional bottom wall 414 and extending between two side walls. A top wall may be integral with the structure or be removably disposable thereon. When removably disposable, the top wall may be removably securable to the structure by any suitable means, including snap and fit. In an embodiment in which a top tray is a removable top tray, the top wall may facilitate easy access to interior cavity 402 of the shelving structure 400 from above.

The shelving structure 400, in the embodiment shown in FIG. 4, includes a top tray 428 disposed on the top wall. The top wall and the tray 428 may be integrally formed with one another or alternatively, the tray may be removably disposable on the top wall. As shown, the top wall and the top tray 428 may be integrally formed with one another as well as being integrally formed with the shelving structure 400.

As shown in FIG. 4, a tray cover 430 is disposed on the top surface of the top tray. The tray cover 430 is secured to the top tray by suitable mechanisms such as hinges 432 which are disposed at the back wall and form a secure enclosure for housing various items (e.g., nutritional supplements, personal effects) in the top tray by way of a snap-fit design. The tray cover at the front, as shown in FIG. 4, includes a thumb-grip 434 for easy snapping off and on of the tray cover from the tray itself. Alternatively the tray cover may be secured to the top tray by way of a snap-fit or any other suitable means, without the thumb-grip.

Shelves 420 may be designed to be removably slide-able in the guiding tracks 426 within the interior cavity 402 of the structure. Shelves, once disposed in the cavity 402, may be removably and slide-ably engaged on two sides to the two side walls of the structure and extend to the back wall. The shelf includes a horizontal surface, which is bound by four edges: two side edges, a back edge, and a front edge. The width of the shelf may extend between the two side edges and may be of sufficient dimensions so as to slide-ably engage the guiding tracks 426, which are formed in the interior surface of the shelving structure 400. Shelf 420 at a back edge may include one or more tabs, each tab including on either side (top or bottom surface of the shelf) a notch which engages with slits that are formed in the back wall of the structure. Shelves 420 may be reversible such that the user does not have to be concerned with which side has to face up or down as the shelf is slid into the guiding tracks. Of course, as can be appreciated, this reversibility in design is optional.

In operation, the notches in the tabs, once engaged with the slits, provide a stop so as to minimize unwanted sliding of the shelves out of the structure. In an embodiment, the front edge of a shelf includes a lip on either side of the tray's front edge. In operation, the lips engage with stop apertures 426 formed in the side wall extensions 422 of the shelving structure 400. The stop apertures are designed so as to be substantially perpendicular to the longitudinal direction of the guiding tracks, and to aid in the securing of the shelves once a shelf has been slid inside the structure cavity. In operation, once the shelf has slid all the way through to the end of the back wall and has engaged therewith (e.g., by way of the tabs), the engagement of the lips with the stop apertures further secures the shelf in the structure. In an embodiment, the stop apertures may be formed integral with the side walls (e.g., without the need to be present in the extension).

One or more shelves may be modularly disposable in the inner cavity of structure 400 so as to accommodate the number and the height of a given container 154 (e.g., food container). By way of example, when a given shelving structure 400 has the capacity to receive five different shelves (and containers thereon), the user may choose not to use all the trays so as to place a taller container in the structure.

The shelves 420 are shaped and designed to hold thereon containers, such as containers 154, 156. The containers can be of any suitable design and material. By way of example, such containers may be formed from material that can withstand being exposed to a range of temperatures as a result of being exposed to oven, stove, microwave, refrigerator, freezer, ambient, and the like. The containers may simply be placed on the trays and may be stored at room temperature (depending on the food item requirements) or may be pre-heated or pre-chilled. If the user wishes to maintain the temperature of the contents of the containers at a desired temperature, packets may be disposed adjacent to the containers to help maintain the desired temperature and minimize heat loss or gain.

The storage assemblies 100, 200, 800, 1500, 1600, 1700, 1800 may be configured for transportability by any suitable means, including, but not limited to, one or more top handles, shoulder straps, harness shoulder straps for being worn on the user's back, and pull out handles secured to the back of the assembly for being pulled by the user. The storage assemblies may further include one or more wheels for ease of transportation when the assembly is being pulled by the user. As can be appreciated, the handle may be placed on the side, as opposed, or in addition to the back of the assembly, for easy of navigation in different pathways having different widths (e.g., airplane aisle).

Figure 5:
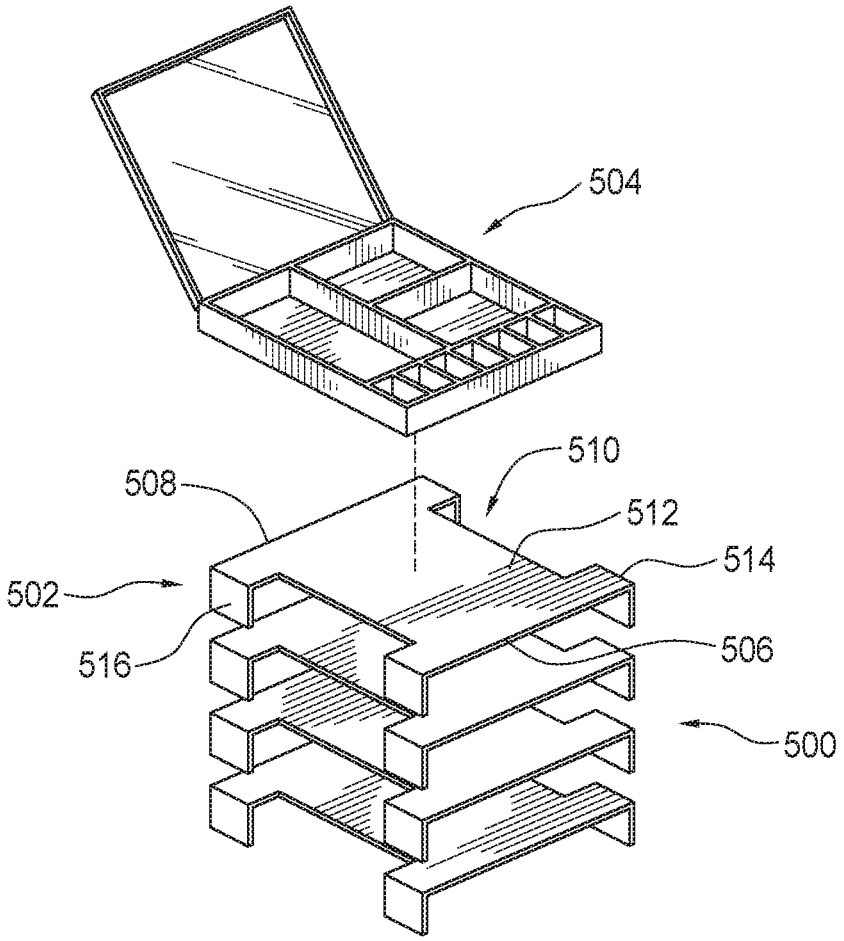
FIG. 5 is a top, perspective exploded view illustrating a rigid structure for use in a convertible storage assembly according to an embodiment.

Now referring to FIG. 5, the storage assembly may include a rigid structure 500 formed from a plurality of shelves 502, and configured to receive a top enclosable top tray 504 disposable on the top surface structure. As shown, the structure 500 is disposable into a compartment, e.g., compartment 148, 150 either from above through a top opening or from the front through, e.g., access doors 120, 122. The plurality of the shelves may be permanently or removably affixable to one another.

The structure 500, as shown, includes a plurality of stackable shelves 502. One or more stackable shelves 502, has top and bottom surfaces, and a front 506, a rear 508, and two side edges. The shelf has a main rectangular surface 510 which is narrower in its center region 512 and wider toward the front and back edges by way of shelf-edge portions or extension 514 which are integrally formed with the rest of the shelf, forming an overall "capital I" shaped shelf surface. The extensions at their side edges include a rigid projection (or "leg") 516 disposed in a substantially perpendicular arrangement to the surface of the shelf. In operation, the shelves can be stacked upon each other and spaced apart from one another by a distance equal to the height of the rigid leg. The shelves may comprise the same or different heights as determined by the height of the rigid legs. In use, the user may stack different shelves having legs of different dimensions in order to accommodate different type of containers in the storage assembly. As shown in FIG. 5, top tray 504 is removably disposable on the top surface of the upper most shelf. In an embodiment, the legs may be removably attachable to another shelf, such that a given shelf may receive legs of the same or different lengths. In this configuration, a consumer may purchase a set number of shelves with a plurality of legs of varying lengths.

Figure 6A:
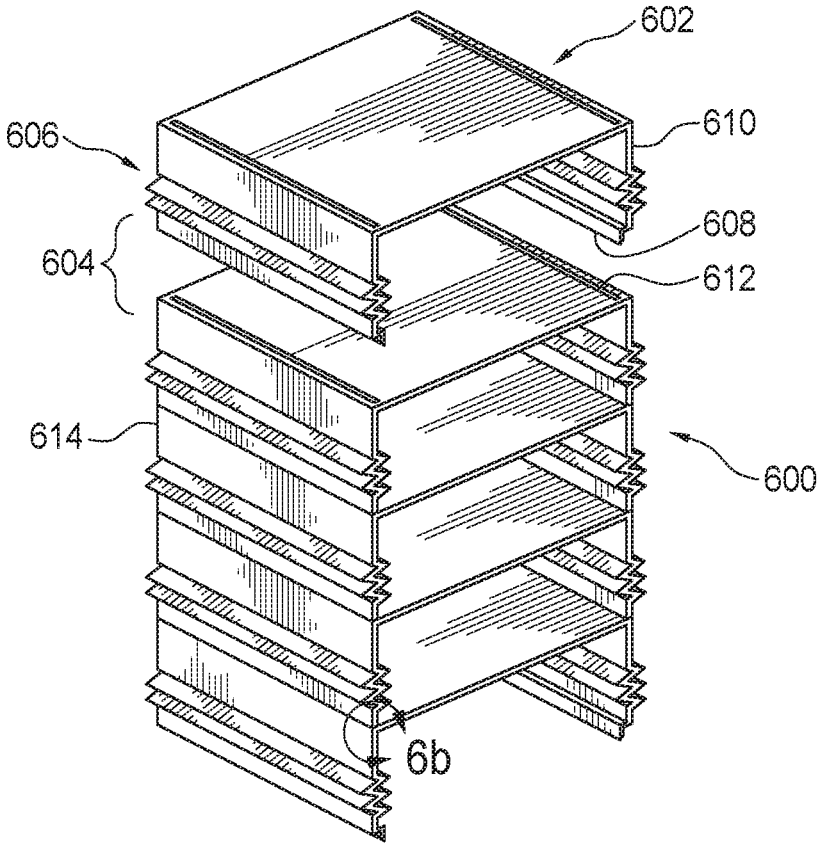
FIG. 6*a* is a side perspective view illustrating a structure for use in an embodiment having an adjustable height shelf design.
Figure 6B:
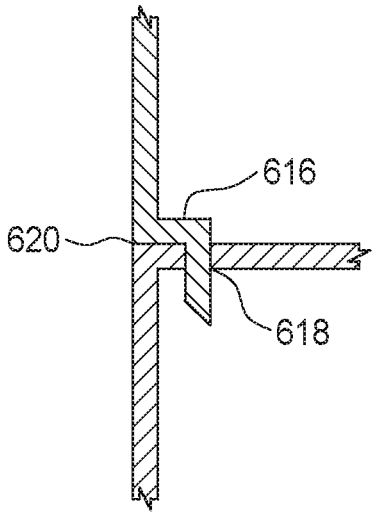
FIG. 6*b* is an enlarged cut away side view illustrating an embodiment of the shelves of FIG. 6*a* being removably secured to one another.

In another embodiment shown in FIG. 6*a*, a structure 600 is shown having a series of stackable shelves 602. The distance (height) 604 between the various shelves is adjustable. One or more bellowed-legs 606 connect a lower surface 614 of an upper shelf leg 610 to an upper surface 612 of a shelf which is disposed immediately below the upper shelf. The distance between the various shelves is adjustable as bellowed-legs are pulled up or pushed down to lengthen or shorten their height, thus adjusting the distance between two vertically adjacent shelves. In the embodiment shown in FIG. 6*b*, a bottom 620 of a bellowed-leg includes a tab 616 for removably being inserted into a groove 618 (snap and fit), thus removably securing the upper and lower shelves with one another.

In an embodiment, the bellowed leg of an upper shelf may be permanently attached to an upper surface of an immediately lower shelf. In this configuration, the distance between the various shelves is still adjustable by moving the bellowed legs up or down (e.g., stretching or compressing the legs).

In the embodiment shown, the structure 600 has five shelves. In an embodiment, a shelf may have its legs compressed so that, effectively, there is no usable space between it and the next lower shelf. This allows for greater separation between other adjacent shelves to allow for containers of various heights. The adjustable distances between the various shelves enable the user to place containers of various heights on the various shelves.

Figure 7A:
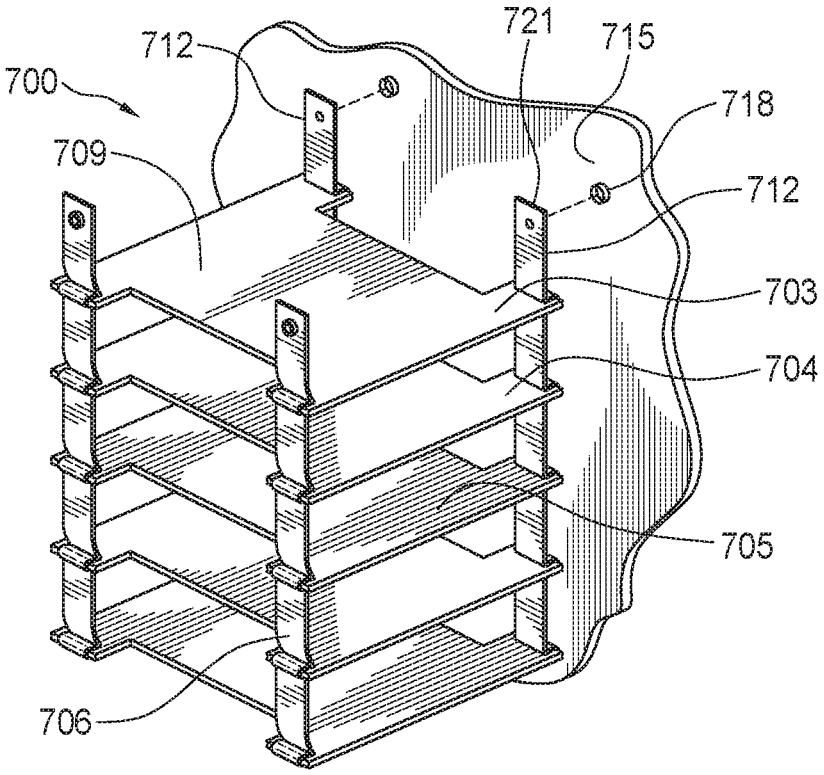
FIG. 7*a* is a perspective view illustrating a shelving system for use in an embodiment and having been expanded from a fragmented interior wall.
Figure 7B:
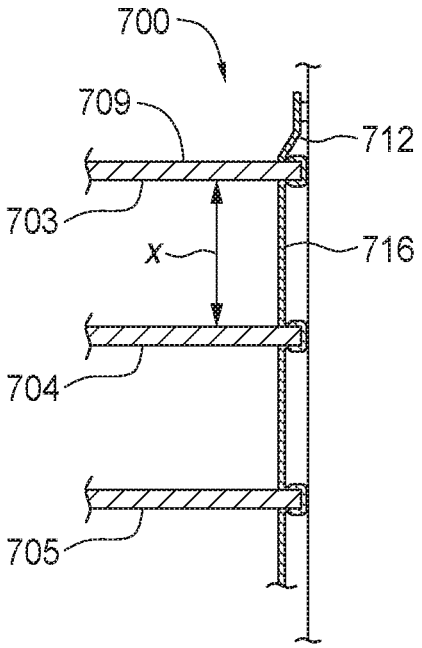
FIG. 7*b* is a sectional view of the shelving system of FIG. 7*a* attached to an interior wall of the storage assembly and having collapsible strips connecting the shelves with one another.

Now referring to FIG. 7, a shelving structure 700 is shown including a plurality of shelves 703. The shelves are connected to one another by way of flexible strips 706 formed from flexible material such as fabric. The upper shelf 709 further includes an attachment strip 712. An inner surface 715 of a compartment, e.g., compartments 148, 150 (see FIG. 1*b*) of a storage assembly, e.g., organizer 100 (see FIG. 1*b*) may be equipped with fastener 718, such as Velcro™ design, snap and fit, or buttons (as shown), or the like which can removably engage a corresponding Velcro™ surface, snap and fit, or button 721 on flexible strip 706. In this embodiment, the flexible strips allow for structure 700 to collapse and expand. The flexible strips allow for compact storage of the shelving structure if needed. In use, the flexibility of the fabric allows for containers of different height to be placed on the various shelves. The maximum height of the shelving structure in expanded configuration, as shown in FIG. 7*b*, is substantially equal to the sum of the length of the various strips in their expanded state. More than one shelving structure may be used with one another in a single storage assembly.

In an embodiment, attachment strips 712 may be removably attached near or on rim 130 (FIGS. 1*a*-2*b*) such that shelving structure 700 lies below a liner 300 (FIGS. 3*a*-3*b*), yet, because structure is hanging from attachment strips 712, shelving structure 700 maintains space between shelves 703 in which suitably-size containers may be inserted. In the embodiment, when it is not desired to carry containers within shelving unit 700, attachment strips 712 may be unattached, allowing structure 700 to collapse below liner 300, and providing more space for liner 300 (this is similar to liner 300 space increasing from space 340 (FIG. 3*b*) to space 305 (FIG. 3*a*) with the removal of containers 154).

FIGS. 4-7*b* illustrate several structures that may be removably positioned within compartments of a convertible storage assembly. These and others are further described in U.S. Pat. No. 8,844,756, entitled "Portable Consumables Organizer," which is incorporated by reference in its entirety.

Figure 8A:
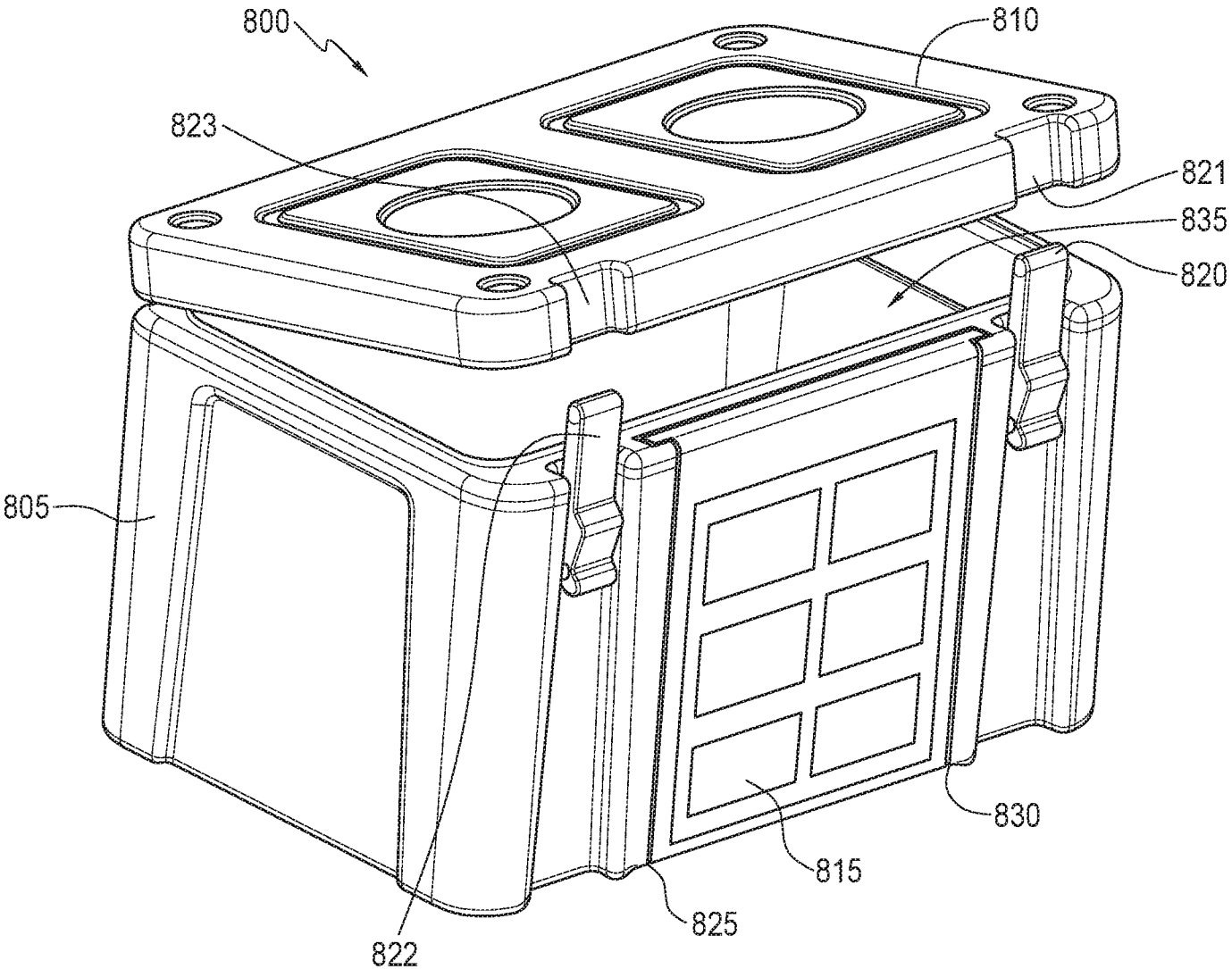
FIG. 8*a* is a top perspective view illustrating a convertible storage assembly according to an embodiment.

FIG. 8*a* is a top perspective view illustrating a convertible storage assembly according to an embodiment. In a convertible storage assembly 800, an apparent difference between storage assembly 800 and storage assemblies 100, 200 is that in storage assembly 800 a single access hatch 815 is in the center of an interior space 835, whereas previously two access hatches 120, 122 were positioned on either side of a central body section 124. In FIG. 8*a*, storage assembly 800 includes a lid 810 with notches 821, 823 for cooperating with latches 820, 822 to retain lid 810 against outer shell 805. Outer shell 805 is equipped with a single access hatch 815 which slides into place within hatch slots 825, 830. In the embodiment shown, when lid 810 is held shut by latches 820, 822, access hatch 815 is also retained in place by lid 810. In an embodiment, slots 825, 830 may be moved forward (out from under lid 810) so that lid 810 does not close on top of hatch 815.

Figure 8C:
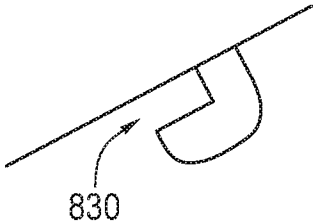
FIGS. 8*c*-8*d* are top views illustrating details of the convertible storage assembly of FIGS. 8*a*-8*b;*
Figure 8D:
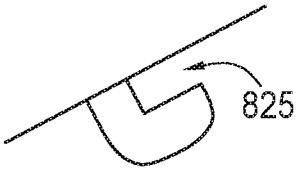
Figure 8B:
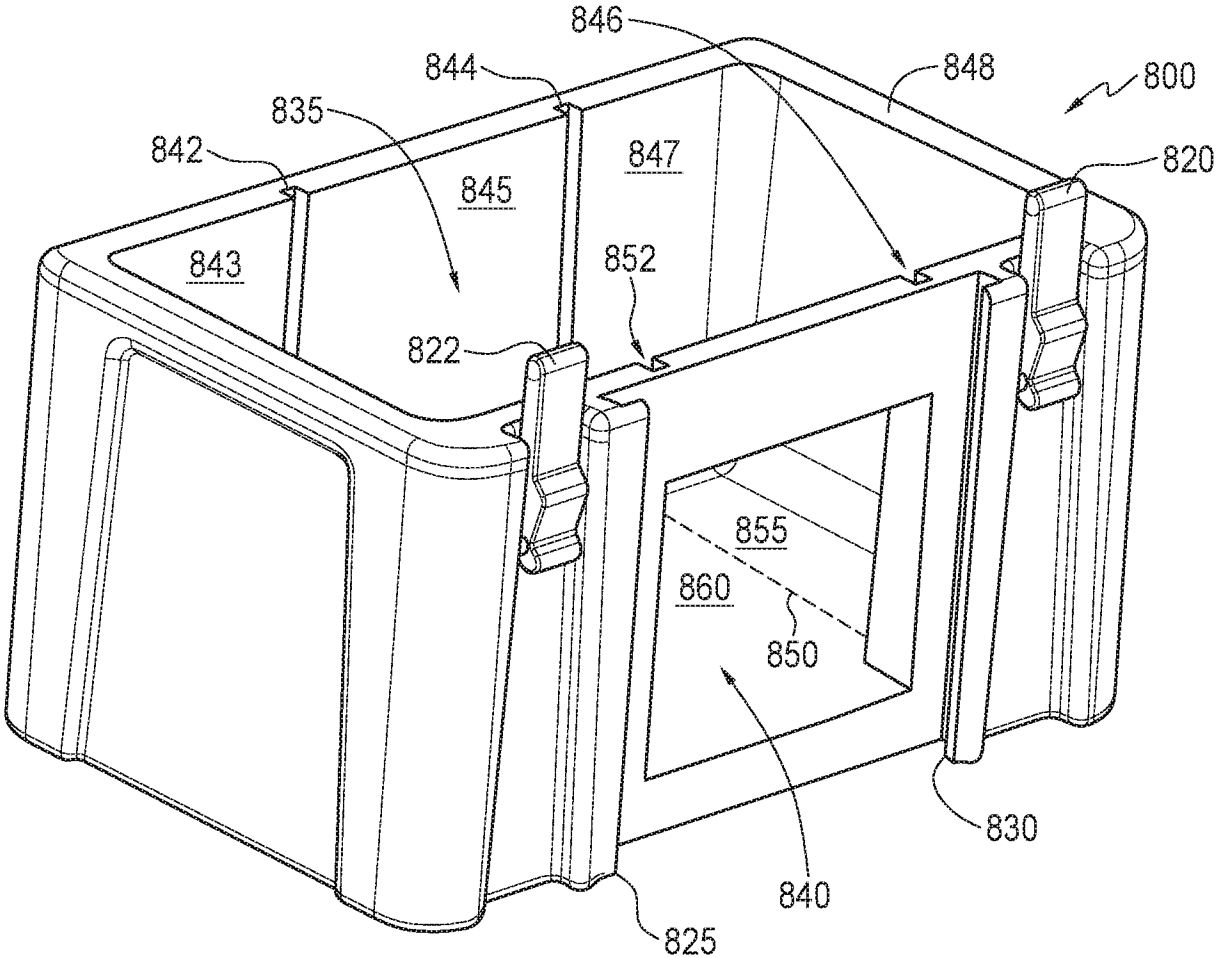
FIG. 8*b* is a top perspective view further illustrating the convertible storage assembly of FIG. 8*a;*

FIG. 8*b* is a top perspective view illustrating the convertible storage assembly of FIG. 8*a*. In FIG. 8*b*, access hatch 815 has been removed to reveal hatch slots 825, 830 (shown in more detail in FIGS. 8*c* and 8*d*). Partition slots 842, 844, 846, and 852 have been formed in the interior surface of outer shell 805. Slots 842, 844, 846, and 852 are dimensioned to accept a partition (not shown) as discussed with reference to FIGS. 2*a* and 2*b*. With partitions in place in slots 842, 844, 846, and 852, interior space 835 is divided into three compartments associated with sections 843, 845, and 847 of the inner surface of outer shell 805. With a partition in place within slots 844, 846, the partition would rest on the floor at line 850, dividing the floor into sections 855, 860.

In an embodiment, a slot may be formed into the floor along line 855. In an embodiment, partitions in slots 842, 844, 846, and 852 form watertight seals with outer body 805 such that sections 843 and 847 are water-retaining. In an embodiment, hatch 815 forms a watertight seal with outer shell 805 such that water may be retained within inner space 835.

Figure 9A:
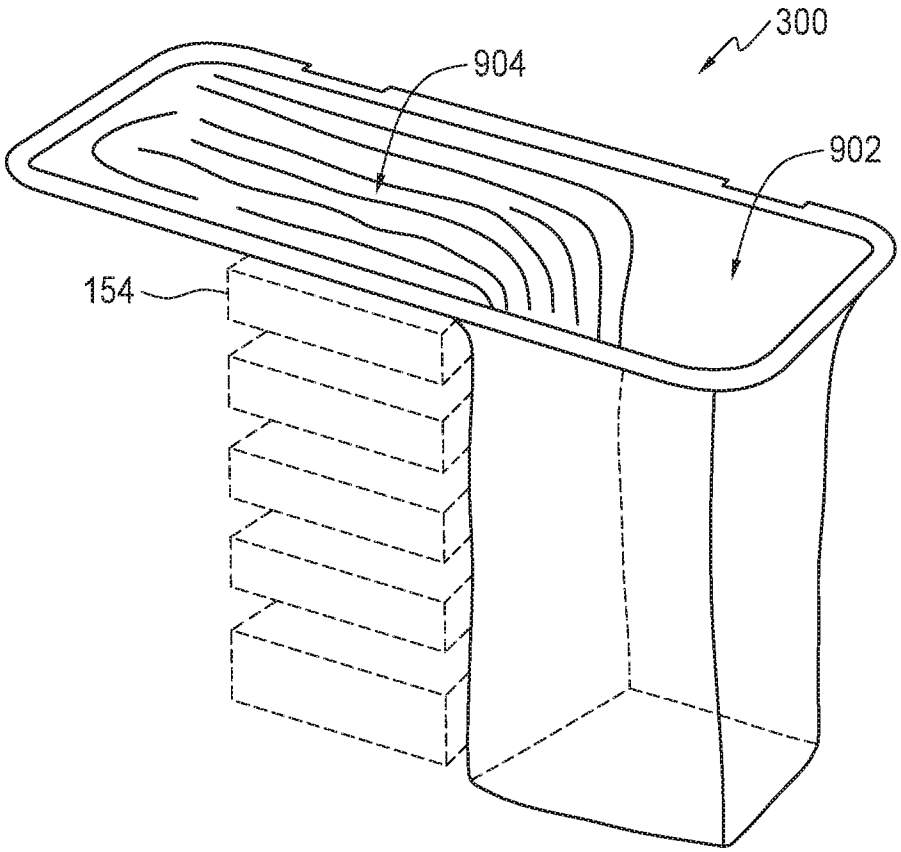
FIGS. 9*a*-9*b* are perspective views illustrating liners for use in convertible storage assemblies according to embodiments.
Figure 9B:
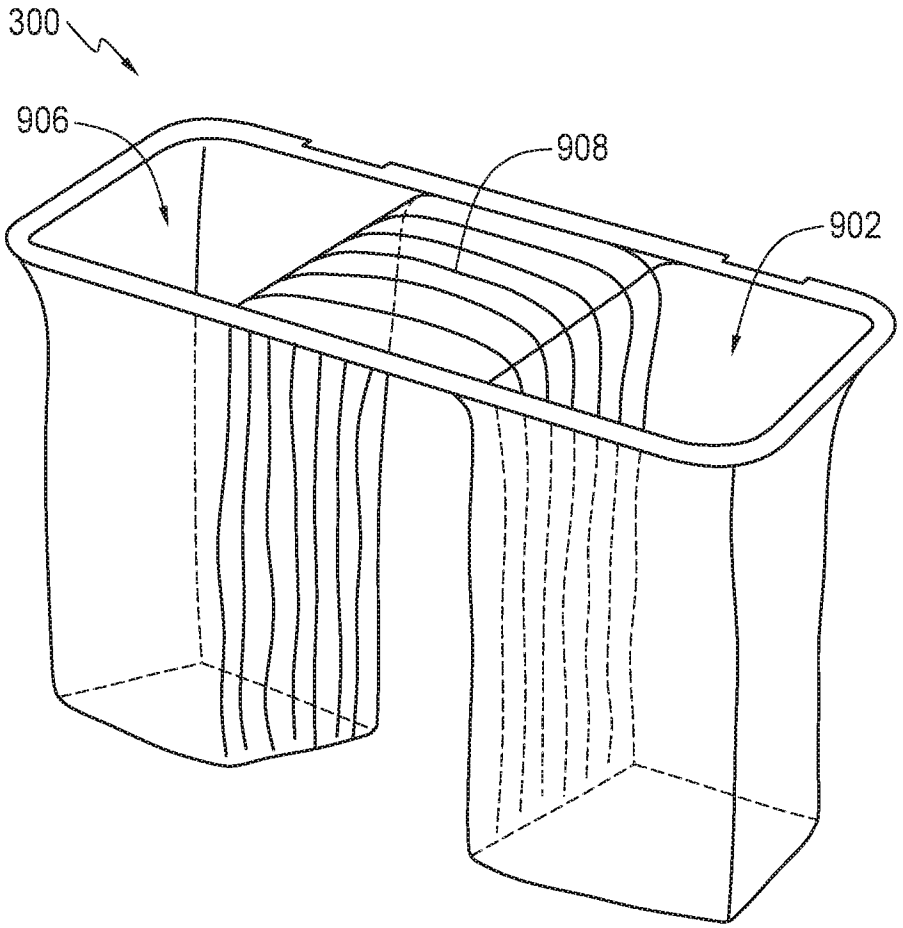

FIGS. 9*a*-9*b* are perspective views illustrating liners for use in convertible storage assemblies according to one or more embodiments. For example, in the embodiment illustrated in FIG. 8*b*, the partitions may not form a watertight seal at line 850. Hatch 815 may also not form a watertight seal. Thus, waterproof liner 300 may be employed as discussed earlier to convert one or more of spaces 843, 845, 847 into a water-retaining space. FIG. 9*a* illustrates liner 300 converting inner space 847 into a water-retaining space 902 (not shown is a partition). Space 902 would be accessible when lid 810 is not fast against shell rim 848. However, spaces 843, 845 and containers 154 within them would be accessible through via hatch 815, but not via lid 810. Because liner 300 is dimensioned to line the entire inner surface of outer shell 805, putting containers 154 in space 845 causes wrinkles 904 to form from all the material displaced from spaces 843, 845.

In FIG. 9*b*, liner 300 has been dimensioned so that even when liner 300 must provide room for objects within space 845, liner 300 has enough extra material to fully line spaces 843, 847, creating spaces 902, 906. Thus, wrinkles 908 are created by liner 300 when it is dimensioned to provide for this contingency.

Figure 10:
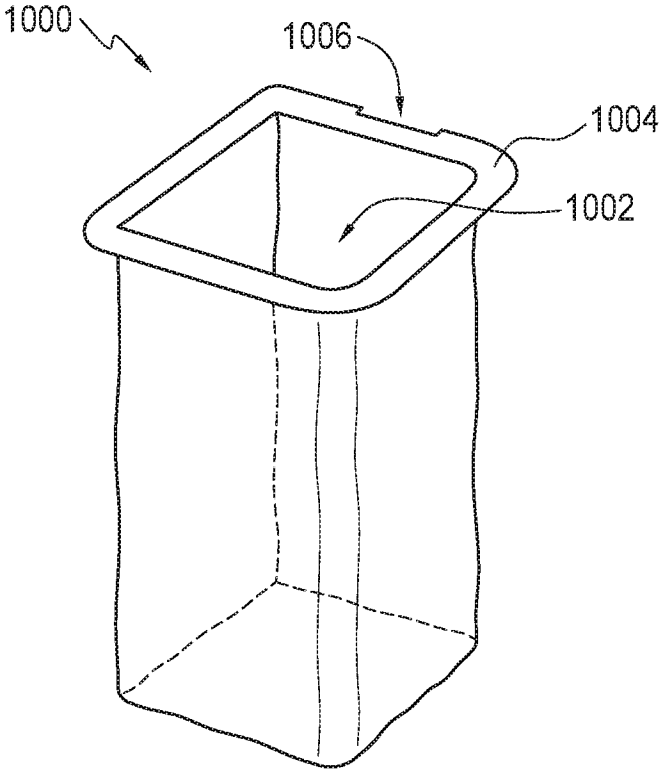
FIG. 10 is a perspective view illustrating a liner for use in convertible storage assemblies according to embodiments.

FIG. 10 is a perspective view illustrating a liner for use in convertible storage assemblies according to embodiments. In FIG. 10, liner 1000 is provided with a rim 1004 and a notch 1006 to accommodate a hinge. Liner 1000 is dimensioned for lining a smaller space than liner 300. For example, liner 1000 may line a single compartment 847 of convertible storage space 800. Using liner 1000 to line space 847 would allow a user to have a water-retaining compartment within liner 1000 and accessible via lid 810. Such an arrangement would leave spaces 843, 845 also accessible via lid 810, and space 845 also accessible via hatch 815. Liner 1000 may also be used to line the space behind hatch 122 (FIGS. 1*a*-1*c*). Should liner 1000 be rigid, it could line such spaces without support from a partition. In an embodiment, a single liner 1000 would be dimensioned to fit and line three equally dimensioned spaces within a convertible storage assembly.

Figure 11:
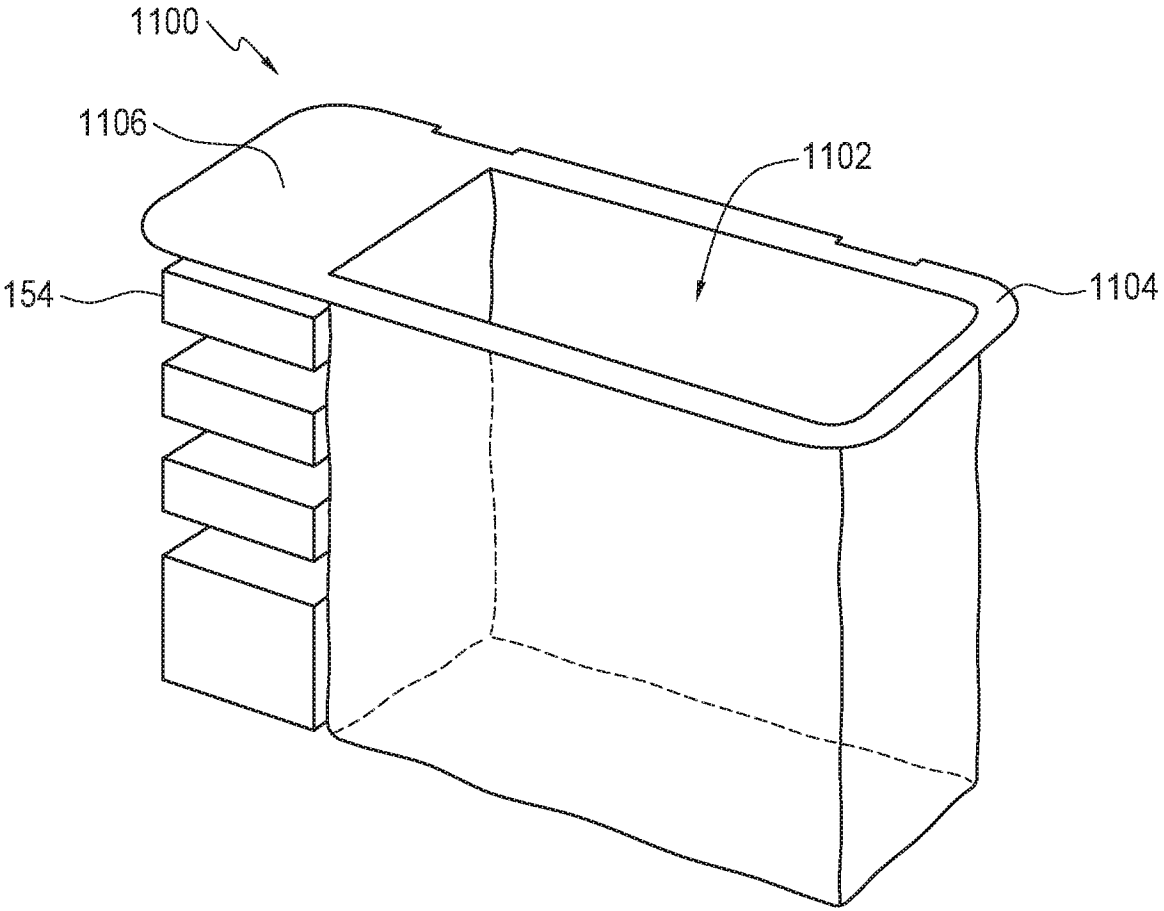
FIG. 11 is a perspective view illustrating a liner for use in convertible storage assemblies according to embodiments.

FIG. 11 is a perspective view illustrating a liner for use in convertible storage assemblies according to embodiments. In FIG. 11 a liner 1100 is dimensioned to line two of the three spaces in outer shell 105 (FIGS. 1*a*-2*b*) creating an interior space 1102. Access to containers 154 may be had via hatch 120. A top section 1106 covers containers 154. In an embodiment, top section 1106 may be flexible enough to fold up and allow access to containers 154. For example, rim 1104 may be attached to a shell rim using sections of hook and loop material and to access containers 154, top section 1106 may be lifted away from the rim, causing the hook and loop closure material to separate and allow access.

Figure 12:
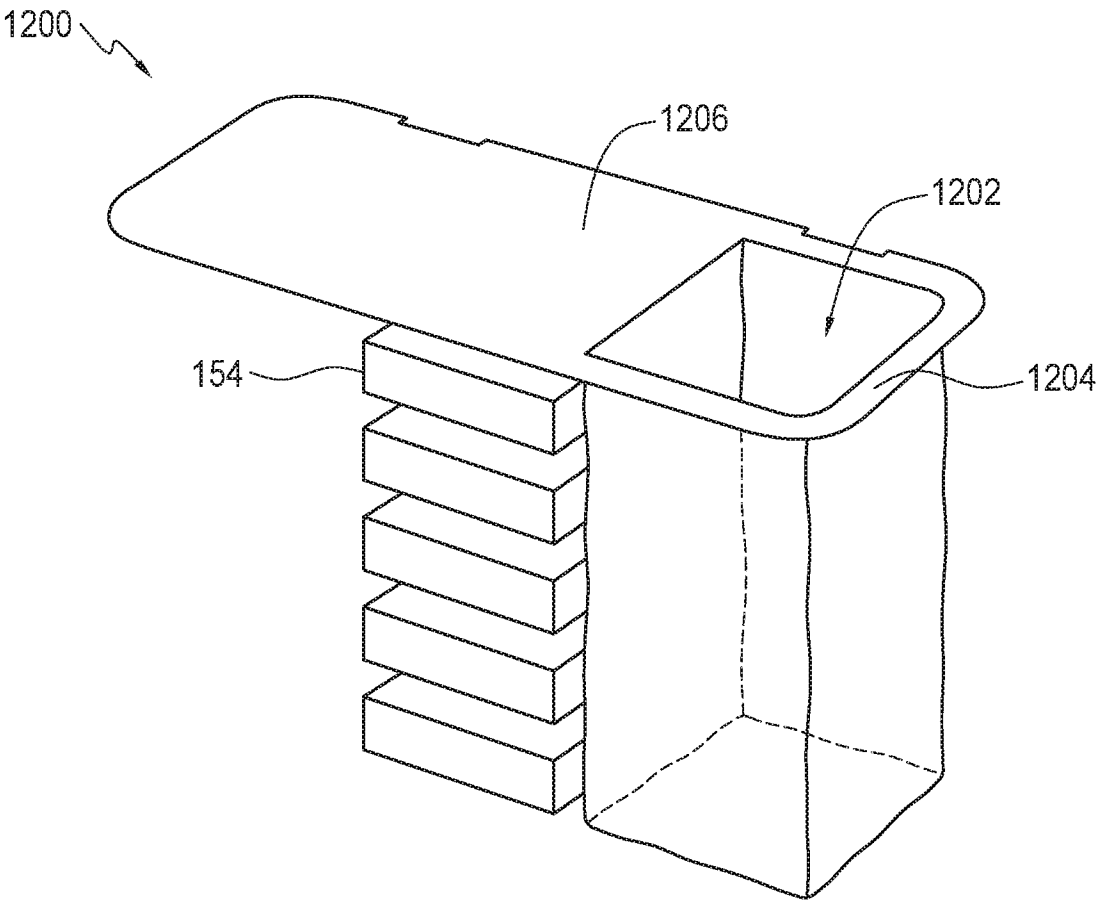
FIG. 12 is a perspective view illustrating a liner for use in convertible storage assemblies according to embodiments.

FIG. 12 is a perspective view illustrating a liner for use in convertible storage assemblies according to embodiments. In FIG. 12 a liner 1200 is dimensioned to line one of the three spaces in outer shell 805 (FIGS. 8*a*-8*b*) creating an interior space 1202. Access to containers 154 and space 843 may be had via hatch 815. A top section 1206 covers containers 154 and space 843. In an embodiment, top section 1106 may be flexible enough to fold up and allow access to containers 154 and space 843. For example, rim 1204 may be attached to a shell rim using sections of hook and loop material and to access containers 154, top section 1206 may be lifted away from the rim, causing the hook and loop closure material to separate and allow access.

Figure 13:
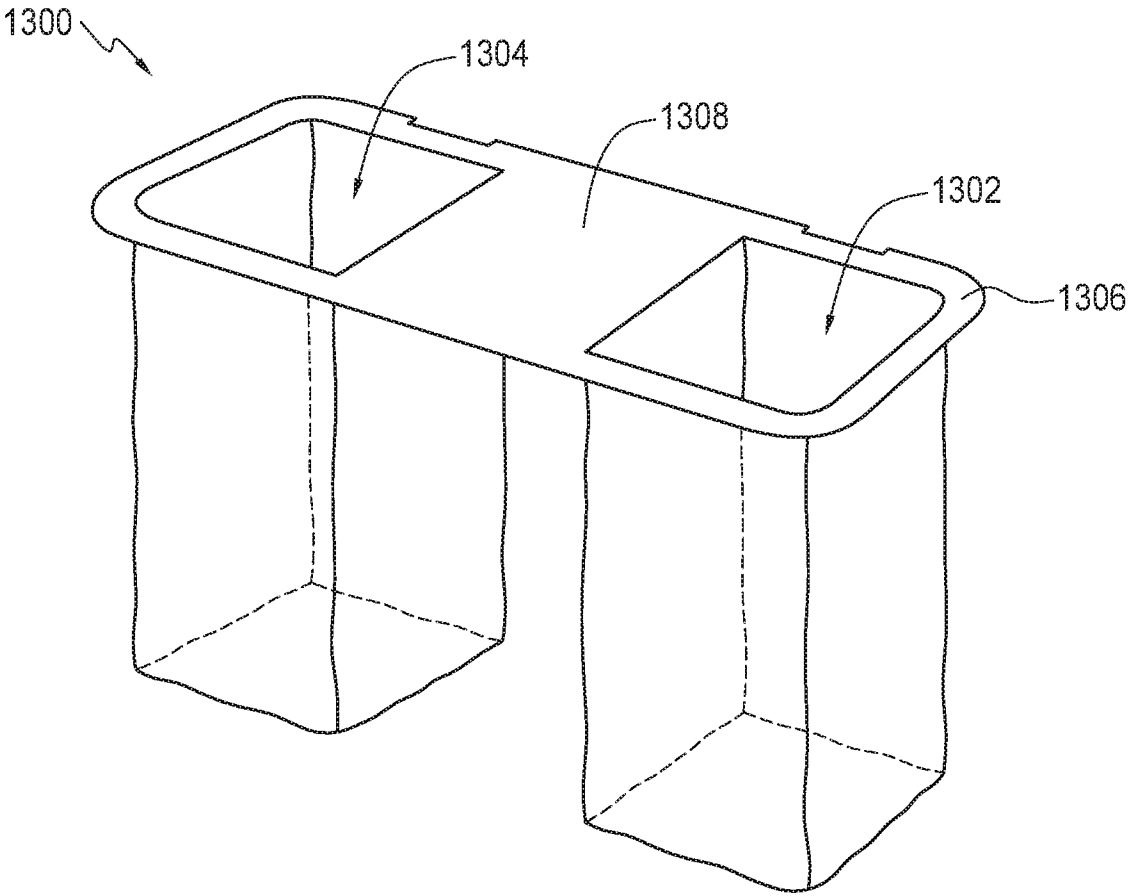
FIG. 13 is a perspective view illustrating a liner for use in convertible storage assemblies according to embodiments.

FIG. 13 is a perspective view illustrating a liner for use in convertible storage assemblies according to embodiments. In FIG. 13 a liner 1300 is dimensioned to line two of the three spaces in outer shell 805 (FIGS. 8*a*-8*b*) creating interior spaces 1302, 1304. Access to center space 845 may be had via hatch 815. A top section 1308 covers space 845.

Figure 14:
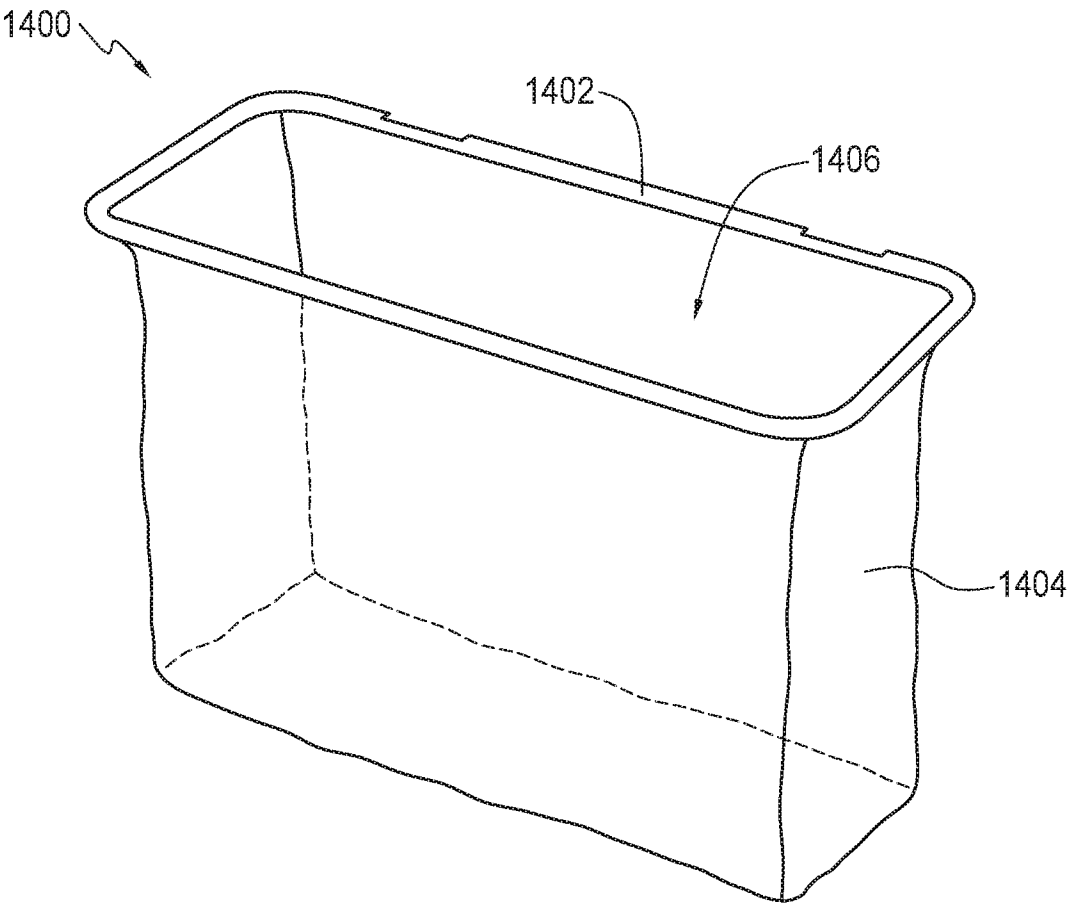
FIG. 14 is a perspective view illustrating a liner for use in convertible storage assemblies according to embodiments.

FIG. 14 is a perspective view illustrating a liner for use in convertible storage assemblies according to embodiments. In FIG. 14, liner 1400 includes a rigid rim 1402 for attaching to a shell rim, e.g., shell rim 130 (FIG. 2*a*) or shell rim 848 (FIG. 8*b*). Rigid rim 1402 may be dimensioned to fit over the shell rim. For example, liner rim 1402 could have a concave lower side that is dimensioned to receive, or snap onto, a shell rim. Thus, liner body 1404 could hang from liner rim 1402. In an embodiment, liner body 1404 may be dimensioned so that it does not extend completely to the floor of an outer shell. Thus, for example, a liner may create an upper layer of a storage space accessible via, e.g., shell lid 110 (FIG. 1*a*-2*b*), and below that liner may exist a lower space accessible through, e.g., hatches 120, 122.

Figure 15:
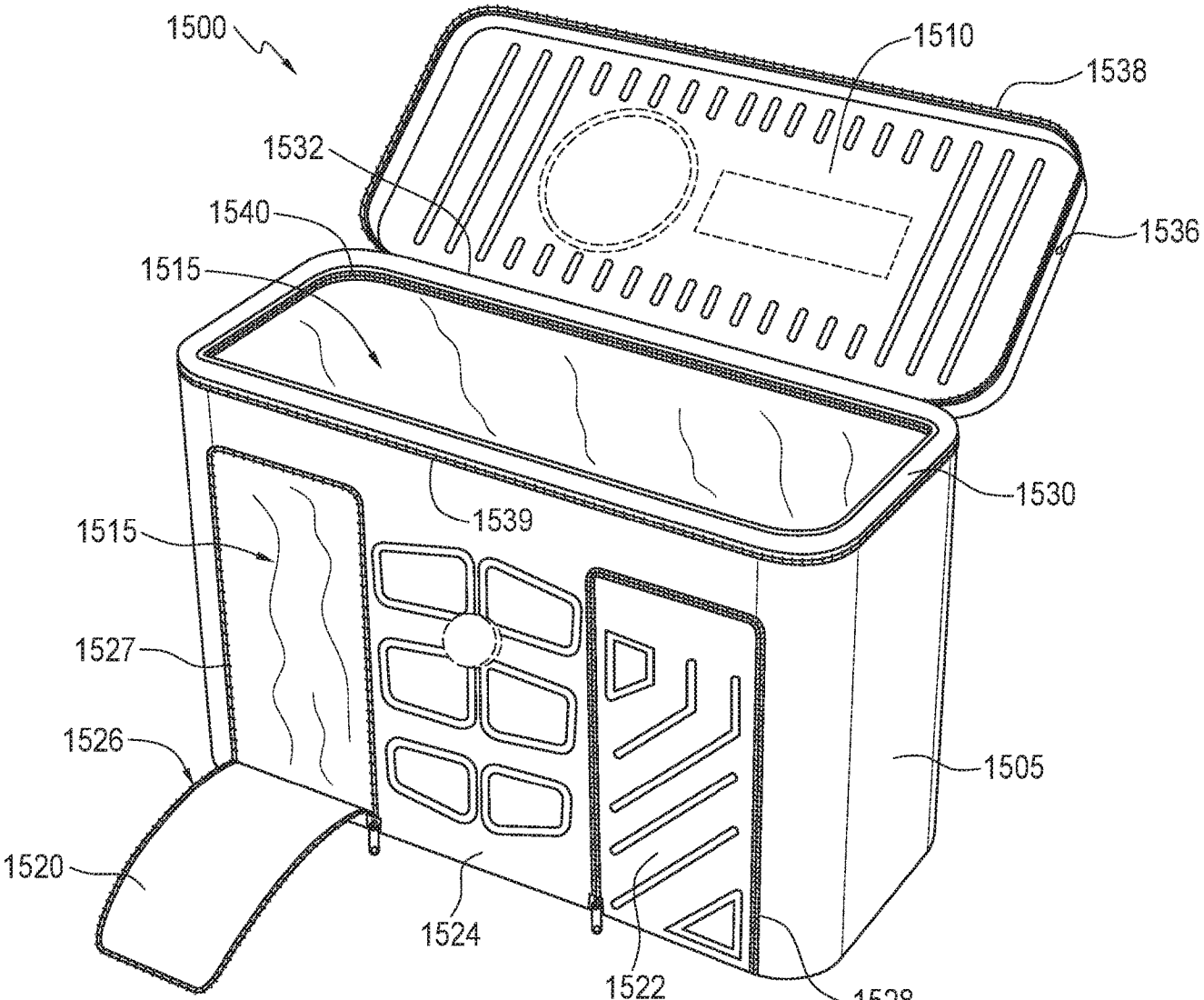
FIG. 15 is a top perspective view illustrating a convertible storage assembly according to an embodiment.

FIG. 15 is a top perspective view illustrating a convertible storage assembly according to an embodiment. In FIG. 15, a softshell convertible storage assembly 1500 includes a soft outer shell 1505 with a flexible liner 1515 attached using a zipper 1540. A flexible lid 1510 is attached to outer shell 1505 using a flexible hinge 1532, e.g., lid 1510 may be partly attached using a zipper half 1538 on lid rim 1536, where zipper half 1538 engages zipper half 1539 on outer shell 1505 (the engaged zipper area is obscured by shell rim 1530). In the embodiment, hatch 1520 is closed using zipper halves 1526, 1527 and hatch 1522 is closed using zipper 1528. An outer shell section 1524 separates hatches 1520, 1522. In the embodiment, hatch 1520 is open to reveal liner 1515. In the embodiment, to store contents behind hatch 1520, liner 1515 may be moved or deformed to provide space behind hatch 1520. Thus, flexible liner 1515 provides for the space behind hatch 1520 to range from essentially nothing (e.g., should liner 1515 be filled) to, potentially, the available space within storage assembly 1500.

Figure 16:
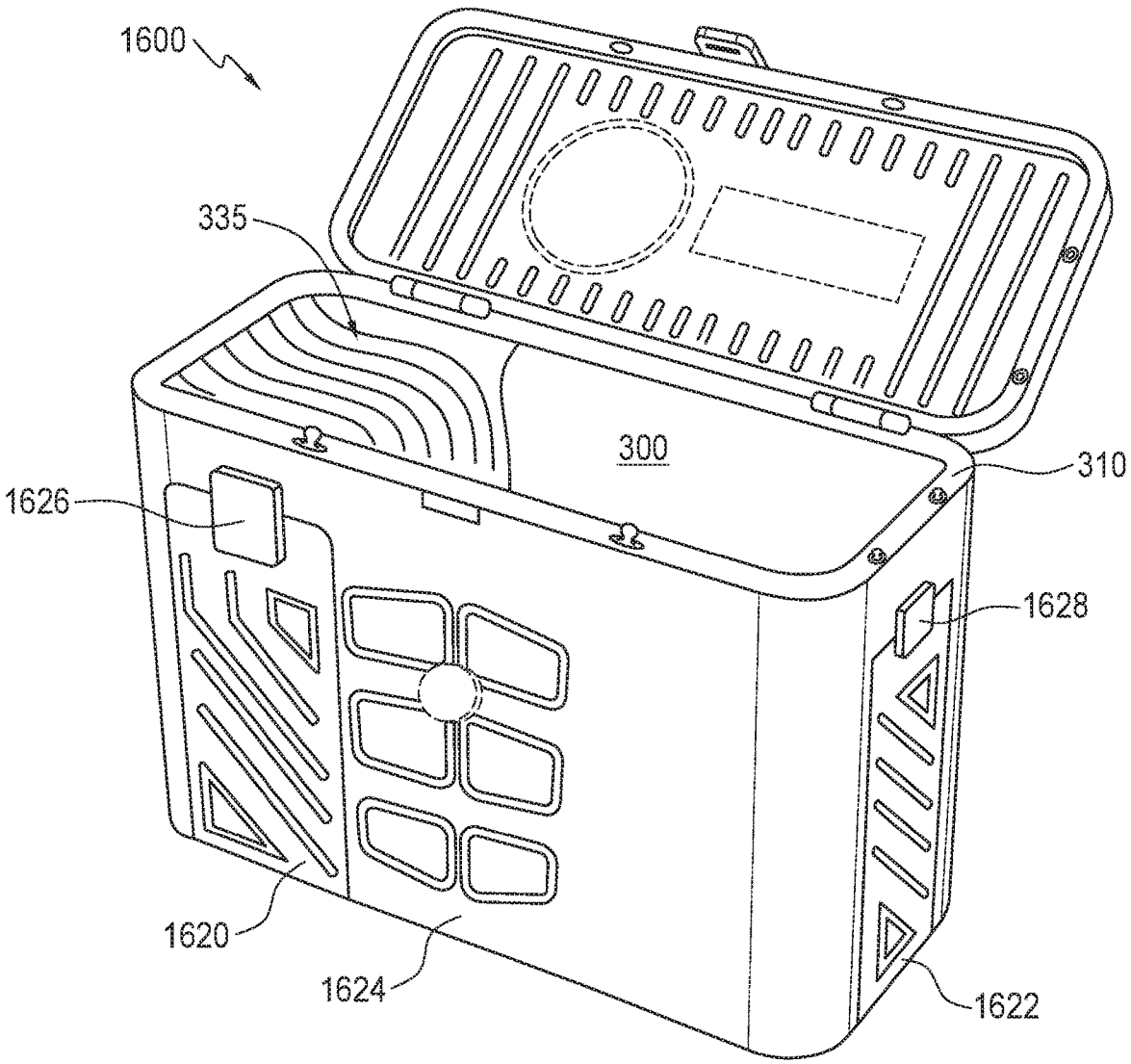
FIG. 16 is a top perspective view illustrating a convertible storage assembly according to an embodiment.

FIG. 16 is a top perspective view illustrating a convertible storage assembly according to an embodiment. In FIG. 16, a convertible storage assembly 1600 includes a hatch 1620 on a first face of an outer shell 1624 and a hatch 1622 on a second face of outer shell 1624. Hatches 1620, 1622 are held closed using latches 1626, 1628, respectively. As can be surmised by wrinkles 335 in liner 300, something beneath liner 300 is causing wrinkles 335 by occupying space behind hatch 1620. Such contents may include, for example, containers 154, shelving structures 400, 500, 600, or 700, or a partition 142.

Figure 17:
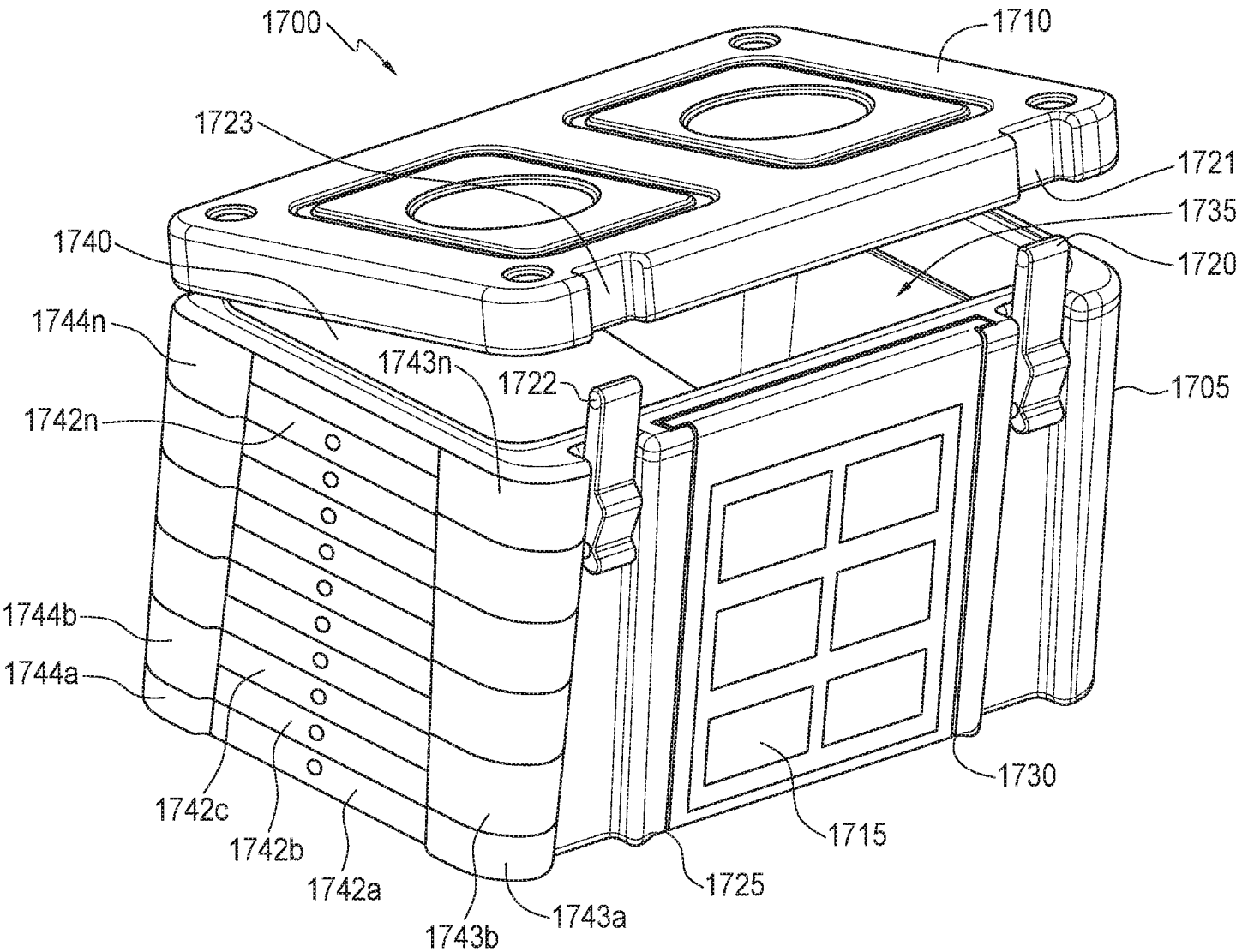
FIG. 17 is a top perspective view illustrating a convertible storage assembly according to an embodiment.

FIG. 17 is a top perspective view illustrating a convertible storage assembly according to an embodiment. In a convertible storage assembly 1700, an apparent difference between storage assembly 1700 and storage assembly 800 is that in storage assembly 1700 what was once space 845 is now occupied by a compartmentalized unit 1740. As with storage assembly 800, storage assembly 1700 includes a single access hatch 1715 providing access to the center of an interior space 1735, a lid 1710 with notches 1721, 1723 for cooperating with latches 1720, 1722 to retain lid 1710 against outer shell 1705. Outer shell 1705 is equipped with a single access hatch 1715 which slides into place within hatch slots 1725, 1730. In the embodiment shown, when lid 1710 is held shut by latches 1720, 1722, access hatch 1715 is also retained in place by lid 1710. In an embodiment, slots 1725, 1730 may be moved forward (out from under lid 1710) so that lid 1710 does not close on top of hatch 1715. In the embodiment, compartmentalized unit 1740 includes a plurality of central compartments 1742*a*, 1742*b*, . . . , 1742*n*, a first plurality of corner compartments 1743*a*, 1743*b*, . . . , 1743*n*, and a second plurality of corner compartments 1744*a*, 1744*b*, . . . , 1744*n*. The number and size of such compartments may be arbitrarily selected. Small compartments may be more suitable for certain activities, e.g., fly fishing, where lures may be extremely small and better kept separate. In contrast, deep sea fishing seemingly requires bigger lures and gear. Then again, compartmentalized unit 1740 may be used to hold food and supplies for eating. Accordingly, various sizes and configurations may be desired in compartmentalized unit 1740. In the embodiment, compartmentalized unit 1740 is sandwiched between lid 1710 and the floor at one end of convertible storage unit 1700. In an embodiment, a bin may be fashioned at the top of compartmentalized unit 1740 that is accessed by opening lid 1710. In an embodiment, the dimensions of lid 1710 are modified so that lid 1710 does not close on top of compartmentalized unit 1740. In this embodiment, compartmentalized unit 1740 may then have additional compartments on top, which, since they are no longer covered by lid 1710, are continuously accessible.

Figure 18:
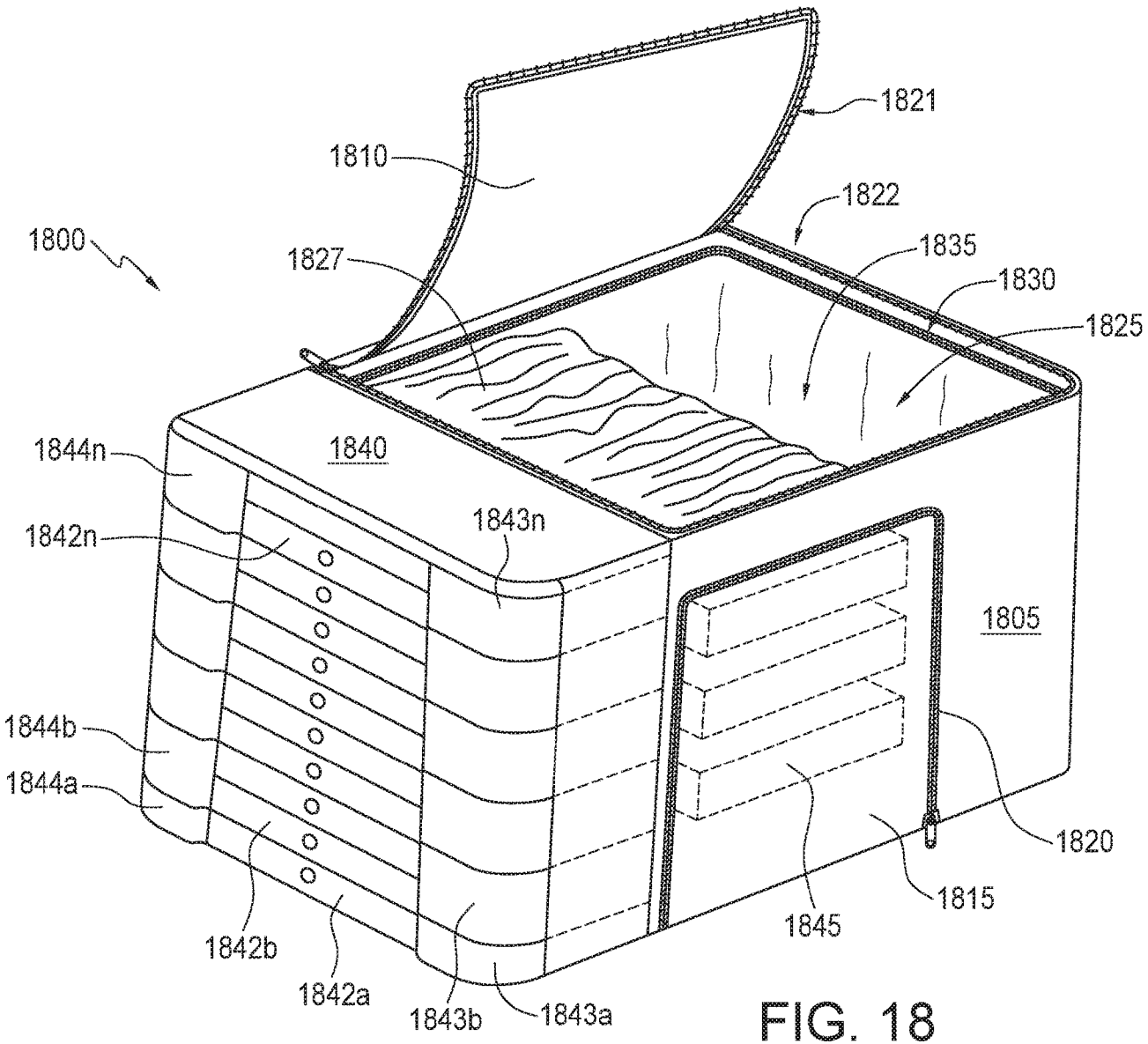
FIG. 18 is a top perspective view illustrating a convertible storage assembly according to an embodiment.

FIG. 18 is a top perspective view illustrating a convertible storage assembly according to an embodiment. In a convertible storage assembly 1800, an apparent difference between storage assembly 1800 and storage assembly 1700 is that storage assembly 1800 has a soft shell attached to a compartmentalized unit 1840. Storage assembly 1800 includes a single access hatch 1815 providing access to, e.g., containers 1845 within an interior space 1835 beneath a wrinkled liner 1827. Storage assembly 1800 includes a lid 1810 with zipper half 1821 for mating with zipper half 1822 in soft outer shell 1805. Outer shell 1805 is equipped with a single zippered hatch 1815 which is closed using a zipper 1820. In the embodiment, compartmentalized unit 1840 includes a plurality of central compartments 1842*a*, 1842*b*, . . . , 1842*n*, a first plurality of corner compartments 1843*a*, 1843*b*, . . . , 1843*n*, and a second plurality of corner compartments 1844*a*, 1844*b*, . . . , 1844*n*. The number and size of such compartments may be arbitrarily configured. Small compartments may be more suitable for certain activities, e.g., fly fishing, where lures may be extremely small and better kept separate. In contrast, deep sea fishing seemingly requires bigger lures and gear. Then again, compartmentalized unit 1840 may be used to hold food and supplies for eating. Accordingly, various sizes and configurations may be desired in compartmentalized unit 1840. In the embodiment, a bin may be fashioned at the top of compartmentalized unit 1840, or compartmentalized unit 1840 may have additional compartments.

As a result, in an embodiment, compartmentalized unit 1840 may, itself, be removed and a different compartmentalized unit substituted in its place within convertible storage assembly 1800. The substitute compartmentalized unit may be chosen for different features, such as having differently sized compartments. In the embodiment, compartmentalized unit 1840 may be removably attached to the soft shell portion of outer shell 1805 so that, if desired, a different compartmentalized unit could be substituted. For example, compartmentalized unit 1840 may be attached to outer shell 1805 using one or more of hook and loop closures, straps, snaps, and zippers. Similarly, the compartmentalized unit 1740 (FIG. 17) may be removably attached to the remainder of shell body 1705 so that one compartmentalized unit with preferable features may be substituted for another with less preferable features.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

All structural and functional equivalents to the elements of the various aspects described throughout this disclosure that are known or later come to be known to those of ordinary skill in the art are expressly incorporated herein by reference and are intended to be encompassed by the claims.

What is claimed is:

1. A storage assembly comprising:

a body including a base area, a first opening, a second opening, and a first interior surface;

a first barrier removably covering the first opening with a second interior surface;

a second barrier removably covering the second opening with a third interior surface; and a first removable waterproof liner, wherein:

the first interior surface, second interior surface, and third interior surface define a first space within the body, the first waterproof liner is configured to divide the first space into a first compartment and a second compartment, the second compartment including a second space between the first waterproof liner and one or both of the first interior surface and the third interior surface, the second space being a subset of the first space, the first barrier is configured such that displacing the first barrier from the first opening provides access to the first compartment and not the second compartment, the second barrier is configured such that displacing the second barrier from the second opening provides access to the second compartment and not the first compartment, the first opening is disposed through an area of the body opposing the base area, the second opening is disposed through the body between the base area and the first opening;

wherein the first opening is disposed on a horizontal top area of the body, the second opening is disposed on a vertical area of the body, and the first waterproof liner is configured such that the second space has a pre-determined shape, and further comprising a second waterproof liner configured to be substitutable for the first waterproof liner and to divide the first space into a third compartment and a fourth compartment, the fourth compartment including a third space between the second waterproof liner and one or both of the first interior surface and the third interior surface, the third space being a subset of the first space, and the second waterproof liner is dimensioned such that the third space has a pre-determined shape different from the second space.

2. The storage assembly of claim 1, further comprising a compartmentalized storage unit removably disposed in the second compartment.

3. The storage assembly of claim 1, wherein the first waterproof liner is flexible and configured to line the first interior surface and the third interior surface, the first barrier is disposed on a horizontal top area of the body, the second barrier is disposed on a vertical area of the body, and the first waterproof liner is flexible such that the second space may change in shape.

4. The storage assembly of claim 3, wherein the first waterproof liner is adaptably configured such that, when a compartmentalized storage unit is removably disposed in the second compartment, the first waterproof liner adapts to the compartmentalized storage unit to divide the first space into a third space on a first side of the second compartment and a fourth space on a second side of the second compartment, the third and fourth spaces being accessible through the first opening and not through the second opening.

5. The storage assembly of claim 1 further comprising a third barrier with a fourth interior surface configured to removably cover a third opening disposed in the body, wherein the first, second, third, and fourth interior surfaces define the first space, wherein the third opening is configured such that it provides access to the second compartment but not the first compartment.

6. A storage assembly comprising a body including a first compartmentalized storage unit, a base area, a first opening, a second opening, and a first interior surface;

a first barrier including a second interior surface configured to removably cover the first opening;

a second barrier including a third interior surface configured to removably cover the second opening; and a first removable waterproof liner, wherein:

the first interior surface, second interior surface, and third interior surface define a first space within the body, the first waterproof liner is configured to divide the first space into a first compartment and a second compartment, the second compartment including a second space between the first waterproof liner and one or both of the first interior surface and the third interior surface, the second space being a subset of the first space, the first barrier is configured such that displacing the first barrier from the first opening provides access to the first compartment and not the second compartment, the second barrier is configured such that displacing the second barrier from the second opening provides access to the second compartment and not the first compartment, the first opening is disposed through an area of the body opposing the base area, and the second opening is disposed through the body between the base area and the first opening, wherein the first opening is disposed on a horizontal top area of the body, the second opening is disposed on a vertical area of the body, and the first waterproof liner is dimensioned such that the second space has a pre-determined shape, further comprising a second waterproof liner configured to be substitutable for the first waterproof liner and to divide the first space into a third compartment and a fourth compartment, the fourth compartment including a third space between the second waterproof liner and one or both of the first interior surface and the third interior surface, the third space being a subset of the first space, and the second waterproof liner is dimensioned such that the third space has a pre-determined shape different from the second space.

7. The storage assembly of claim 6 further comprising a second compartmentalized storage unit removably disposed in the second compartment.

8. The storage assembly of claim 6, wherein the first waterproof liner is flexible and configured to line the first interior surface and the third interior surface, the first opening is disposed on a horizontal top area of the body, the second opening is disposed on a vertical area of the body, and the first waterproof liner is flexible such that the second space may change in shape.

9. The storage assembly of claim 8, wherein the first waterproof liner is adaptably configured such that, when a compartmentalized storage unit is removably disposed in the second compartment, the first waterproof liner adapts to the compartmentalized storage unit to divide the first space into a third space on a first side of the second compartment and a fourth space on a second side of the second compartment, the third and fourth spaces being accessible through the first opening and not the second opening.

10. The storage assembly of claim 6 further comprising a third barrier with a fourth interior surface removably covering a third opening in the first compartment, wherein the first, second, third, and fourth interior surfaces define the first space, wherein displacing the third barrier from the third opening provides access to the second compartment but not the first compartment.

11. A storage assembly comprising:

a body including a base area, a first opening, a second opening, and a first interior surface;

a first barrier removably covering the first opening with a second interior surface;

a second barrier removably covering the second opening with a third interior surface; and a first partition removably disposed within the first space, wherein:

the first interior surface, second interior surface, and third interior surface define a first space, the first partition is configured to divide the first space into a first compartment and a second compartment, the first barrier is configured such that displacing the first barrier from the first opening provides access to the first compartment and the second compartment, the second barrier is configured such that displacing the second barrier from the second opening provides access to the second compartment and not the first compartment, the first opening is disposed through an area of the body opposing the base area, the second opening is disposed through the body between the base area and the first opening, and the first partition and the body are configured to create a first watertight seal between the first partition and the body and the second barrier and the body are configured to create a second watertight seal between the body and the second barrier, such that the first compartment and second compartment retain water when the storage assembly is oriented base-down.

12. The storage assembly of claim 11 further comprising a compartmentalized storage unit removably disposed in the second compartment.

13. The storage assembly of claim 11, wherein, when the storage assembly is oriented base-down, the first opening is disposed on a horizontal top area of the body, the second opening is disposed on a vertical area of the body, and the first partition is vertically oriented within the first space.

14. The storage assembly of claim 13 further comprising a second partition removably disposed within the first space, wherein:

the second partition is configured to divide the second compartment into a third compartment and a fourth compartment, the first barrier is configured such that displacing the first barrier from the first opening provides access to the first compartment, the third compartment, and the fourth compartment, the second barrier is configured such that displacing the second barrier from the second opening provides access to the third compartment and not the first compartment and not the fourth compartment, the first opening is disposed through an area of the body opposing the base area, the second opening is disposed through the body between the base area and the first opening, and the second partition and the body are configured to create a third watertight seal between the second partition and the body, such that the first compartment and fourth compartment retain water when the storage assembly is oriented base-down and the second barrier is displaced from the second opening.

15. The storage assembly of claim 11, wherein the body further includes a compartmentalized storage unit.

16. The storage assembly of claim 15, wherein the first barrier is configured such that displacing first barrier provides access to at least one compartment of the compartmentalized storage unit.

* * * * *